US009242815B2

(12) United States Patent
Okumura et al.

(10) Patent No.: US 9,242,815 B2
(45) Date of Patent: Jan. 26, 2016

(54) MEDIUM SUPPLY DEVICE

(71) Applicant: PFU Limited, Kahoku-shi, Ishikawa (JP)

(72) Inventors: Hideyuki Okumura, Kahoku (JP); Kiichiro Shimosaka, Kahoku (JP); Ryoichi Yasukawa, Kahoku (JP)

(73) Assignee: PFU LIMITED, Ishikawa (JP)

( * ) Notice: Subject to any disclaimer, the term of this patent is extended or adjusted under 35 U.S.C. 154(b) by 0 days.

(21) Appl. No.: 14/086,698

(22) Filed: Nov. 21, 2013

(65) Prior Publication Data

US 2014/0203494 A1 Jul. 24, 2014

(30) Foreign Application Priority Data

Jan. 18, 2013 (JP) ..... 2013-007608

(51) Int. Cl.
*B65H 3/52* (2006.01)
*B65H 3/06* (2006.01)
*B65H 3/56* (2006.01)

(52) U.S. Cl.
CPC ..... *B65H 3/063* (2013.01); *B65H 3/0653* (2013.01); *B65H 3/5284* (2013.01); *B65H 3/56* (2013.01); *B65H 2402/46* (2013.01); *B65H 2404/52* (2013.01); *B65H 2404/6942* (2013.01)

(58) Field of Classification Search
CPC ..... B65H 1/04; B65H 1/025; B65H 3/60; B65H 1/00; B65H 1/266; B65H 3/063; B65H 3/56; B65H 3/0653; B65H 2404/52; B65H 2404/6942
USPC ..... 271/121, 145, 165, 167, 161
See application file for complete search history.

(56) References Cited

U.S. PATENT DOCUMENTS 5,052,676 A * 10/1991 Shiina ..... B65H 3/5238 271/121
5,118,091 A * 6/1992 Nagamoto ..... B65H 3/063 271/122
5,549,289 A 8/1996 Sonnenburg et al.
5,707,057 A * 1/1998 Oyama ..... B65H 3/54 271/121
5,975,518 A 11/1999 Wakana et al.
6,010,126 A 1/2000 Mou et al.

(Continued)

FOREIGN PATENT DOCUMENTS

CN 101746621 A 6/2010
CN 102803107 A 11/2012

(Continued)

OTHER PUBLICATIONS

U.S. Office Action issued in U.S. Appl. No. 14/141,138 dated Jun. 17, 2014.

(Continued)

*Primary Examiner* — Prasad Gokhale
(74) *Attorney, Agent, or Firm* — McDermott Will & Emery LLP

(57) ABSTRACT

A medium supply device includes a feeding unit that feeds a medium among one or more media placed on a placing table, a separating unit that is arranged to come into pressure-contact with the feeding unit, a blocking portion that is movable and blocks a space formed between the feeding unit and the separating unit in an upstream side of a nip region in a conveying direction of the medium, and a curve-forming portion that presses the medium against the feeding unit side to form a curve in a width direction of the medium.

2 Claims, 28 Drawing Sheets

(56) References Cited

U.S. PATENT DOCUMENTS

| | | | | |
|---|---|---|---|---|
| 6,017,031 | A * | 1/2000 | Oosawa | B65H 3/56 271/10.09 |
| 6,290,224 | B1 | 9/2001 | Lin | |
| 6,318,716 | B1 | 11/2001 | Okuda | |
| 6,550,761 | B1 | 4/2003 | Chiang | |
| 7,055,817 | B2 * | 6/2006 | Werner | B65H 3/063 271/121 |
| 7,140,607 | B2 * | 11/2006 | Graef | B65H 3/5246 271/110 |
| 7,374,162 | B2 | 5/2008 | Sonoda et al. | |
| 7,559,546 | B2 | 7/2009 | Sonoda et al. | |
| 7,806,402 | B2 * | 10/2010 | Sato | B65H 5/002 271/10.11 |
| 7,841,592 | B2 * | 11/2010 | Wu | B65H 3/5238 271/121 |
| 8,118,299 | B2 | 2/2012 | Sato | |
| 8,469,355 | B2 * | 6/2013 | Miwa | B65H 1/04 271/117 |
| 8,496,241 | B2 | 7/2013 | Osakabe et al. | |
| 8,708,327 | B2 * | 4/2014 | Suzuki | B65H 1/06 271/130 |
| 8,764,158 | B2 | 7/2014 | Asai et al. | |
| 8,985,570 | B1 * | 3/2015 | Fang | B65H 1/04 271/121 |
| 2007/0063421 | A1 * | 3/2007 | Demmeler | B65H 3/06 271/121 |
| 2007/0108696 | A1 | 5/2007 | Yorimoto | |
| 2007/0262511 | A1 | 11/2007 | Ohshima et al. | |
| 2008/0203652 | A1 | 8/2008 | Yasukawa et al. | |
| 2009/0309293 | A1 | 12/2009 | Hung et al. | |
| 2014/0203494 | A1 | 7/2014 | Okumura et al. | |

FOREIGN PATENT DOCUMENTS

| | | | |
|---|---|---|---|
| CN | 203714879 | U | 7/2014 |
| JP | 9-301590 | A | 11/1997 |
| JP | 2001-130769 | A | 5/2001 |
| JP | 2005-094060 | A | 4/2005 |
| JP | 2007-145442 | A | 6/2007 |
| JP | 2012-153471 | A | 8/2012 |

OTHER PUBLICATIONS

Office Action Chinese Patent Application No. 2015103000001670 dated Nov. 4, 2015.

* cited by examiner

FIG.14

| No | SYM-BOL | CONTENT | UNIT | FIRST ARM | SECOND ARM |
|---|---|---|---|---|---|
| | | | | RELATED ITEM | RELATED ITEM |
| 1 | $\theta_{ap1}$ | ANGLE BETWEEN ARM AND SHEET CONVEYING DIRECTION (FIRST SURFACE) | DEG-REE | No. 8, 9, 10, 11 | No. 8, 9, 10, 11 |
| 2 | $\theta_{ap2}$ | ANGLE BETWEEN ARM AND SHEET CONVEYING DIRECTION (SECOND SURFACE) | DEG-REE | No. 8, 9, 10, 11 | No. 8, 9, 10, 11 |
| 3 | $H_{arm}$ | ARM ANGLE CHANGE POINT HEIGHT | mm | No.1, 2 | No.1, 2 |
| 4 | $P_{arm}$ | DISTANCE BETWEEN INTERSECTION BETWEEN ARM AND PICK ROLLER AND ARM LOWEST POINT (DIRECTION ORTHOGONAL TO SHEET CONVEYING DIRECTION) | $P_{arm}$ | | |
| 5 | $L_{tip}$ | DISTANCE BETWEEN SEPERATION NIP INLET AND INTERSECTION BETWEEN ARM AND PICK ROLLAR WHEN VIEWED FROM AXIAL DIRECTION OF ROLLAR (SHEET CONVEYING DIRECTION) | mm | | |
| 6 | $L_{prj}$ | DISTANCE BETWEEN SEPERATION NIP INLET AND ARM LOWEST POINT WHEN VIEWED FROM AXIAL DIRECTION OF ROLLAR (SHEET CONVEYING DIRECTION) | mm | No.1, 5 | No.1, 5 |
| 7 | $W_{prj}$ | LOWEST POINT PORTION WIDTH OF ARM | mm | | |
| 8 | $F_{arm}$ | BIASING FORCE OF ARM TO SHEET (DIRECTION ORTHOGONAL TO SHEET CONVEYING DIRECTION) | mN | | |
| 9 | $A_{arm}$ | FULCRUM POSITION OF ARM ROTATION (DIRECTION ORTHOGONAL TO SHEET CONVEYING DIRECTION) | mm | No. 2, 8, 10, 11 | No. 2, 8, 10, 11 |
| 10 | $B_{arm}$ | FULCRUM POSITION OF ARM ROTATION (SHEET CONVEYING DIRECTION) | mm | No. 2, 8, 9, 11 | No. 2, 8, 9, 11 |
| 11 | $\mu_{ap}$ | FRICTION COEFFICIENT BETWEEN ARM AND SHEET | - | No. 1, 2, 8, 9 | No. 1, 2, 8, 9 |

MEDIUM SUPPLY DEVICE

CROSS-REFERENCE TO RELATED APPLICATIONS

This application is based upon and claims the benefit of priority from Japanese Patent Application No. 2013-007608, filed on Jan. 18, 2013, the entire contents of which are incorporated herein by reference.

BACKGROUND OF THE INVENTION

1. Field of the Invention

The present invention relates to a medium supply device.

2. Description of the Related Art

Hitherto, there is a medium supply device including a feeding unit and a separating unit (for example, refer to Japanese Patent Application Laid-open No. 2001-13769).

In the medium supply device, regarding the suppression of the occurrence of a jam of a medium, there is still room for improvement.

SUMMARY OF THE INVENTION

It is an object of the present invention to at least partially solve the problems in the conventional technology. According to an aspect of the present invention, a medium supply device comprises a feeding unit that feeds a medium among one or more media placed on a placing table; a separating unit that is arranged to come into pressure-contact with the feeding unit; a blocking portion that is movable and blocks a space formed between the feeding unit and the separating unit in an upstream side of a nip region in a conveying direction of the medium; and a curve-forming portion that presses the medium against the feeding unit side to form a curve in a width direction of the medium.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 14 is a diagram illustrating a list of the design parameters of the arms;

DETAILED DESCRIPTION OF THE PREFERRED EMBODIMENTS

Hereinafter, a medium supply device according to an embodiment of the present invention will be described in detail with reference to the drawings. Meanwhile, the present invention is not limited by the embodiment. The components in the following embodiment include components that can be easily assumed by those skilled in the art or practically the same components.

Embodiment

Figure 1:
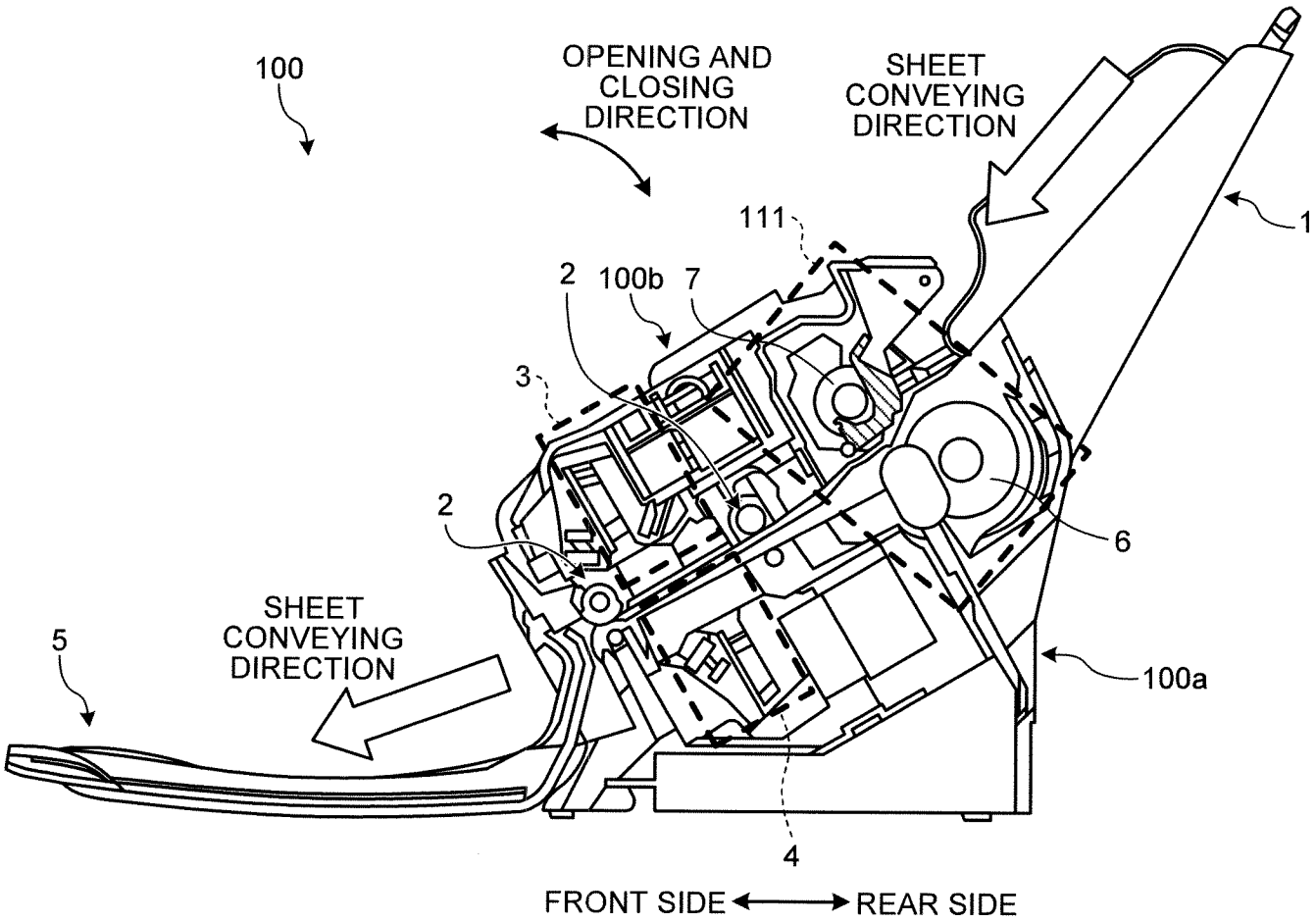
FIG. 1 is a cross-sectional view illustrating a schematic configuration of an image reading apparatus according to an embodiment.
Figure 2:
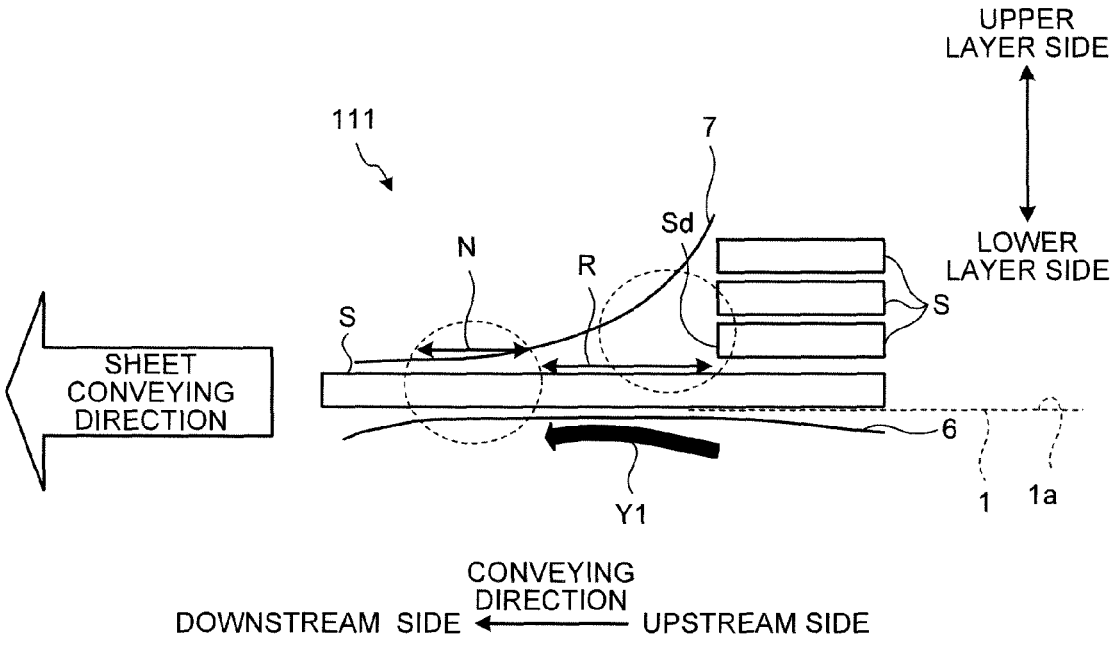
FIG. 2 is a diagram illustrating places where jam likely to occur.
Figure 3:
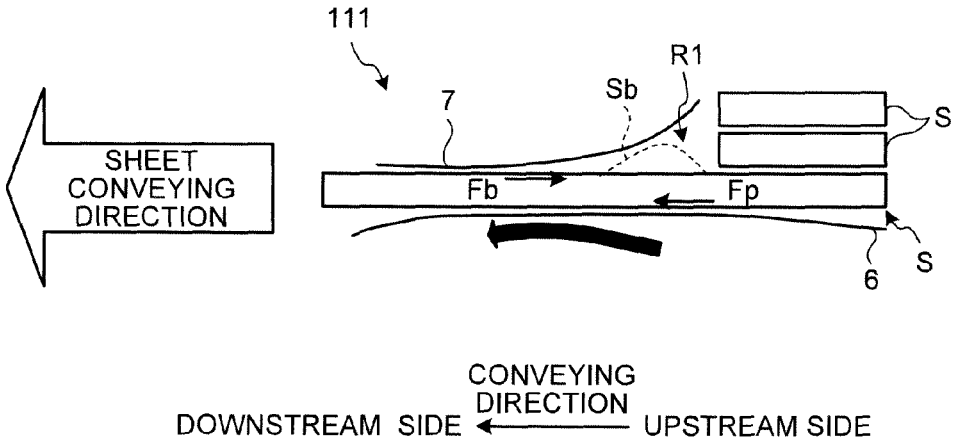
FIG. 3 is a diagram illustrating buckling of a medium.
Figure 4:
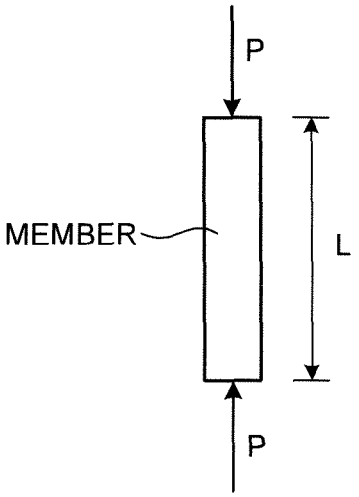
FIG. 4 is a diagram illustrating conditions of the buckling.
Figure 5:
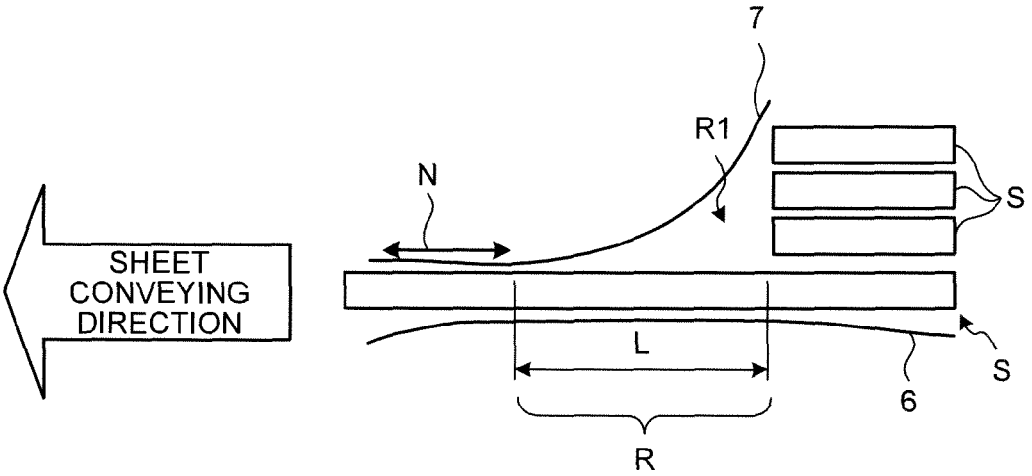
FIG. 5 is an explanatory diagram of a length associated with buckling.
Figure 6:
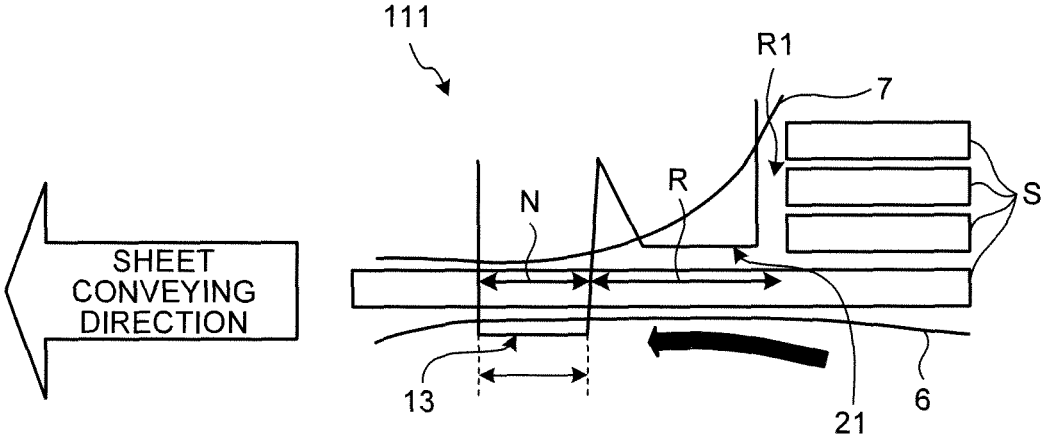
FIG. 6 is a cross-sectional view illustrating the schematic configuration of a medium supply device according to the embodiment.
Figure 7:
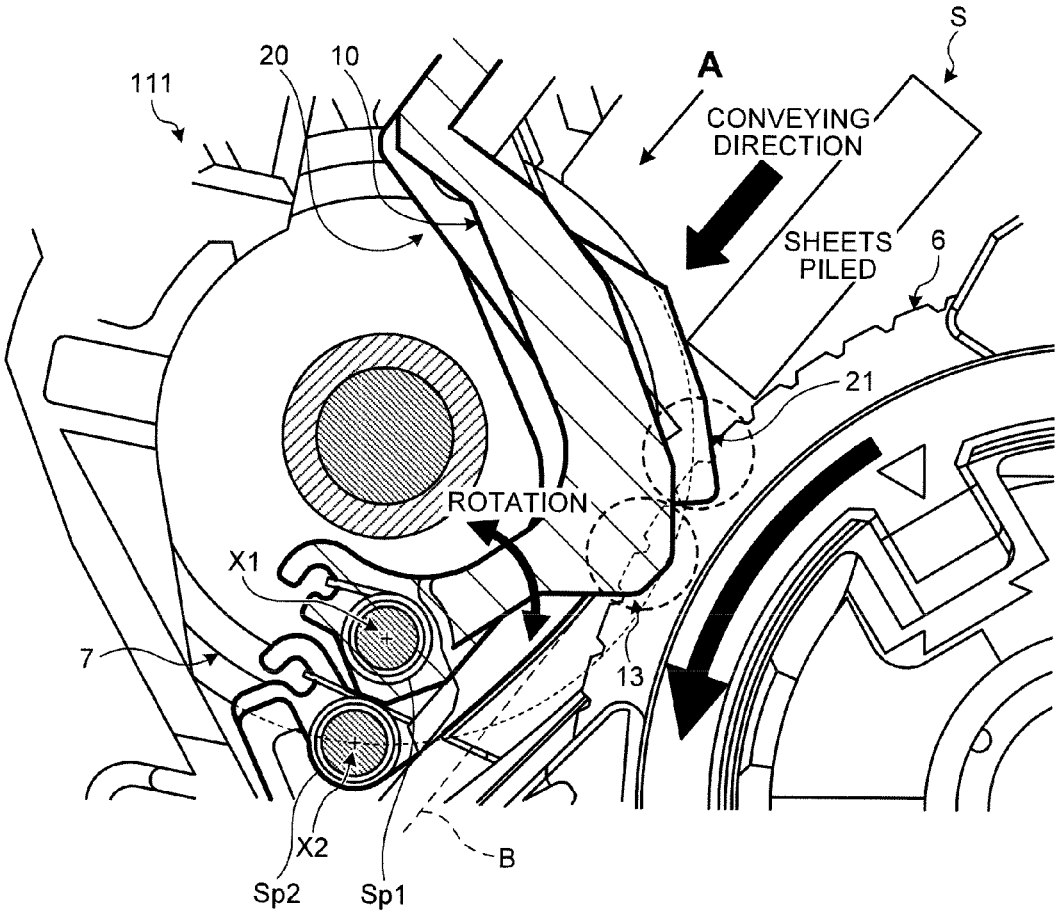
FIG. 7 is a cross-sectional view illustrating main parts of the medium supply device according to the embodiment.
Figure 8:
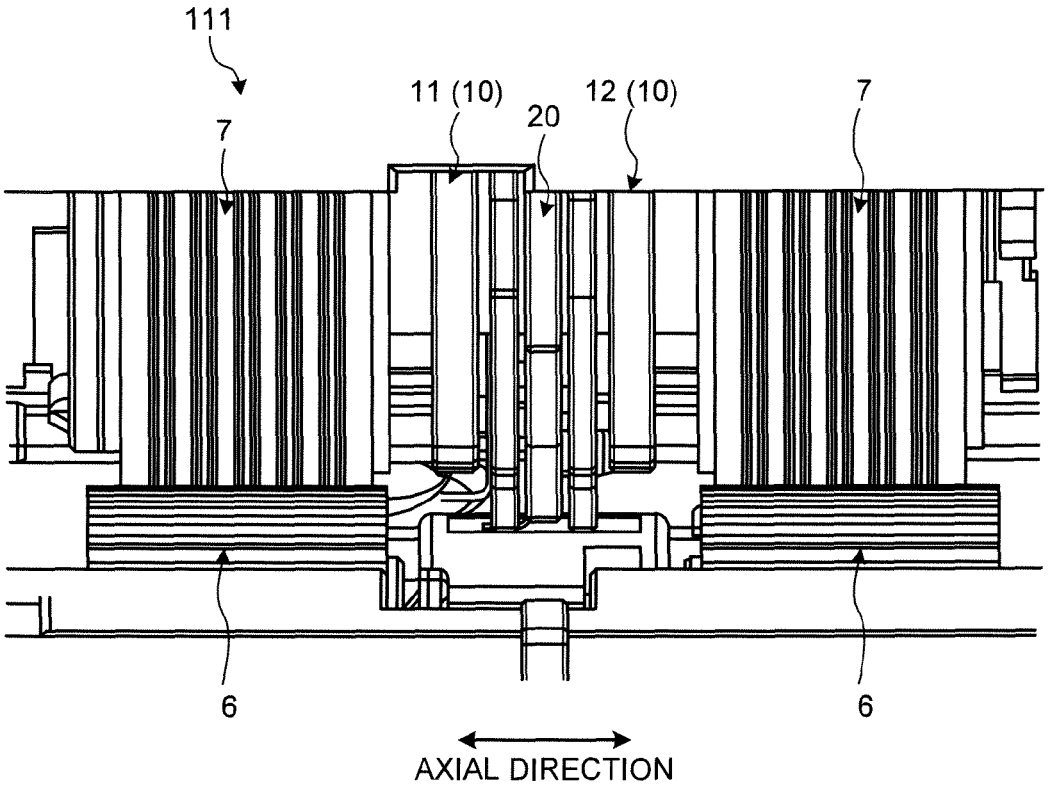
FIG. 8 is a front view illustrating the main parts of the medium supply device viewed from direction of arrow A in FIG. 7 according to the embodiment.
Figure 9:
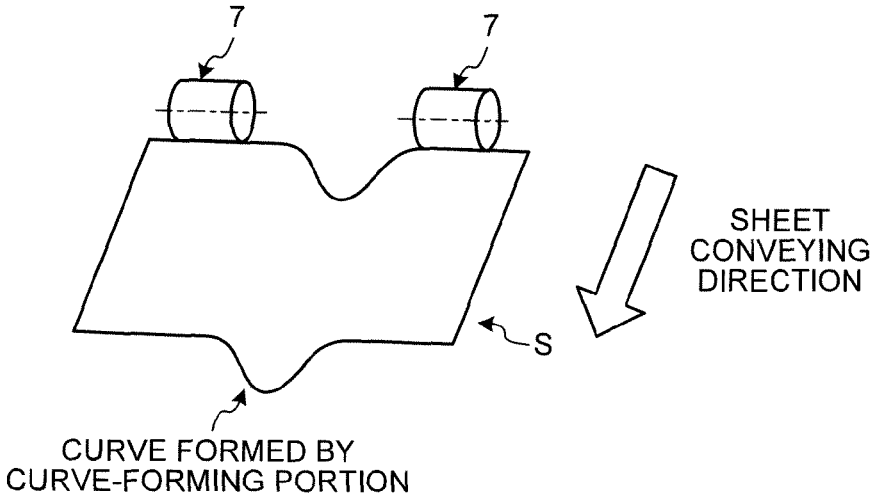
FIG. 9 is a perspective view illustrating a curve of the medium formed by a curve-forming portion of the medium supply device of the embodiment.
Figure 10:
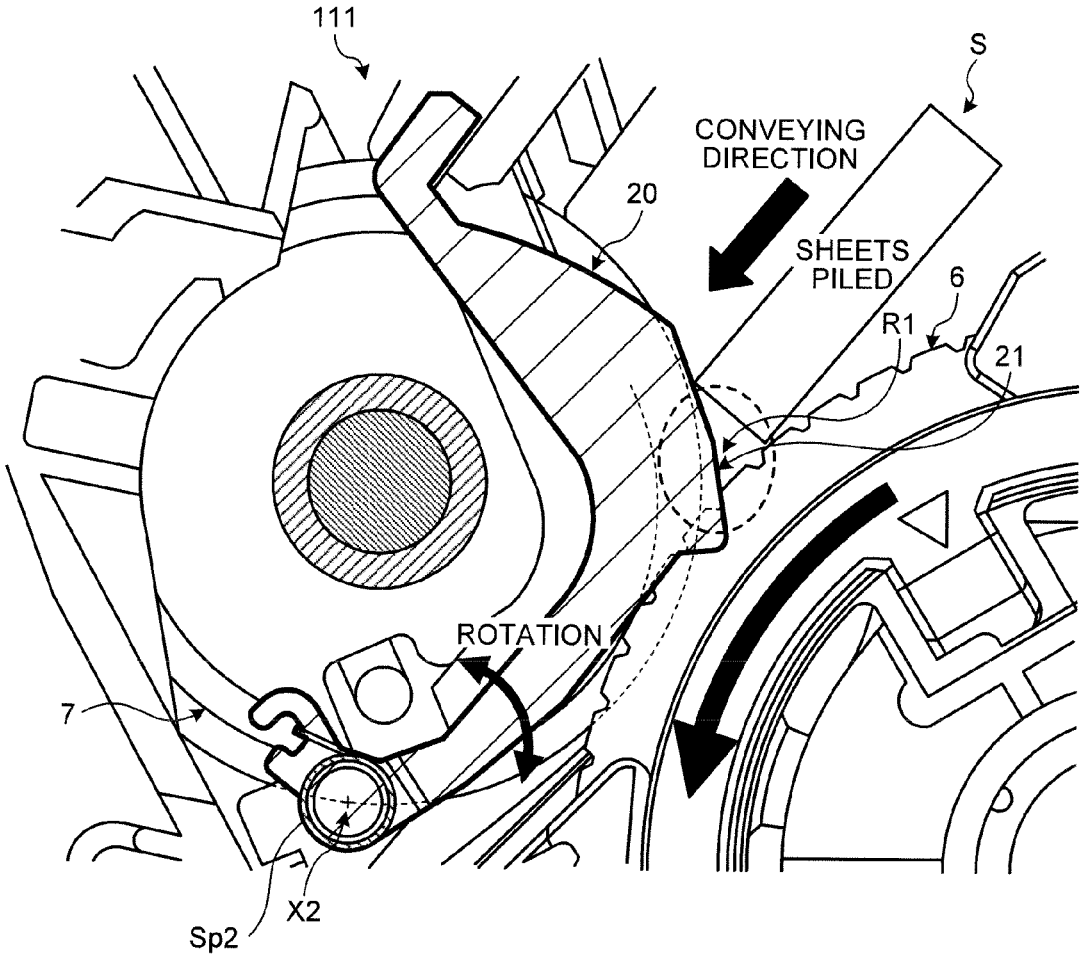
FIG. 10 is a diagram illustrating a state where the jam is suppressed by a second arm.

The embodiment will be described with reference to FIGS. 1 to 30. This embodiment relates to a medium supply device. FIG. 1 is a cross-sectional view illustrating a schematic configuration of an image reading apparatus according to an embodiment. FIG. 2 is a diagram illustrating places where jam likely to occur. FIG. 3 is a diagram illustrating buckling of a medium. FIG. 4 is a diagram illustrating conditions of the buckling. FIG. 5 is an explanatory diagram of a length associated with buckling. FIG. 6 is a cross-sectional view illustrating the schematic configuration of a medium supply device according to the embodiment. FIG. 7 is a cross-sectional view illustrating main parts of the medium supply device according to the embodiment. FIG. 8 is a front view illustrating the main parts of the medium supply device viewed from direction of arrow A in FIG. 7 according to the embodiment. FIG. 9 is a perspective view illustrating a curve of the medium formed by a curve-forming portion of the medium supply device of the embodiment. FIG. 10 is a diagram illustrating a state where the jam is suppressed by a second arm.

As illustrated in FIG. 1, an image reading apparatus 100 according to the embodiment includes a medium supply device 111, a chute 1, a conveying roller 2, a first image reading unit 3, a second image reading unit 4, and a stacker 5.

The chute 1 is provided at the rear side of the image reading apparatus 100. The chute 1 is a placing table on which a plurality of media S (see FIG. 2) is placed to be piled up. The medium supply device 111 sends the media S placed on the chute 1 in a sheet conveying direction one by one. The conveying roller 2 transports the media S fed by the medium supply device 111 in the sheet conveying direction. The first image reading unit 3 reads an image on the front surface (upper surface) of the medium S and generates image data of the front surface image. The second image reading unit 4 reads an image on the back surface (lower surface) of the medium S and generates image data of the back surface image. The stacker 5 is provided at the front side of the image reading apparatus 100. The media S of which the images are read by the image reading units 3 and 4 are discharged to the front side of the image reading apparatus 100 by the conveying roller 2 and are placed on the stacker 5.

The image reading apparatus 100 includes a main body section 100*a* placed on a desk or the like and a rotating section 100*b*. The rotating section 100*b* is supported to be rotatable relative to the main body section 100*a* and can rotate in an opening and closing direction illustrated in FIG. 1. A pick roller 6 and the second image reading unit 4 of the medium supply device 111 are provided in the main body section 100*a*. A brake roller 7 and the first image reading unit 3 of the medium supply device 111 are provided in the rotating section 100*b*.

As illustrated in FIG. 2, the medium supply device 111 includes the pick roller 6 and the brake roller 7. On a placing surface 1*a* of the chute 1, the plurality of media S are placed to be piled up. The pick roller 6 is a feeding unit which feeds the media S placed on the chute 1. The pick roller 6 is disposed to come into contact with the lower surface of the medium S placed closest to the placing surface 1*a* side (lower layer side). The pick roller 6 is driven to rotate by a driving device (not illustrated), for example, a motor. A rotational direction Y1 of the pick roller 6 is a direction in which the contacting medium S is fed in the sheet conveying direction.

The brake roller 7 is a separating unit disposed to come into pressure-contact with the pick roller 6. That is, the pick roller 6 and the brake roller 7 are arranged so as to contact with each other at the outer peripheral surfaces thereof and to press with each other in the radial direction. The brake roller 7 exerts a frictional force on the medium S interposed between the brake roller 7 and the pick roller 6 in a direction opposite to the conveying direction. In a case where one or more media S overlapping the medium S to be conveyed are fed by the pick roller 6, the brake roller 7 separates the one or more media S overlapping other than the medium S to be conveyed to suppress multiple-feeding of the plurality of media S.

Here, places where a jam of the medium S is apt to occur are present in the medium supply device 111. One of the places is a nip region N. The nip region N is a region where the pick roller 6 and the brake roller 7 come into pressure-contact with each other. The nip region N is a region where the outer peripheral surface of the pick roller 6 and the outer peripheral surface of the brake roller 7 press against each other in a case where the medium S is not present between the pick roller 6 and the brake roller 7, and is a region where the outer peripheral surface of the pick roller 6 and the outer peripheral surface of the brake roller 7 press against each other with the medium S interposed therebetween in a case where the medium S is interposed between the pick roller 6 and the brake roller 7. In the nip region N, since the direction of a force received by the medium S from the pick roller 6 and the direction of a force received by the medium S from the brake roller 7 are opposite to each other, a jam of the medium S is apt to occur.

Further, a jam of the medium S is apt to occur in a region R positioned on the upstream side in the conveying direction in relation to the nip region N in a conveying path of the medium S. The upstream side region R is a region from an end Sd on the downstream side in the conveying direction of the medium S placed on the chute 1 to an end on the upstream side in the conveying direction of the nip region N. In the upstream side region R, a jam is apt to occur due to buckling as described below.

As illustrated in FIG. 3, a force in the conveying direction (pick-conveyance force Fp) is exerted by the pick roller 6 on the fed medium S. Meanwhile, a brake force Fb in the opposite direction to the conveying direction is exerted by the brake roller 7. Here, in the upstream side region R, a space R1 is present on the brake roller 7 side with respect to the transported medium S. The space R1 is a space formed between the medium S fed by the pick roller 6, the brake roller 7, and the media S placed on the chute 1 when viewed from the axial direction of the pick roller 6. Since the space R1 is present, as illustrated by the broken line Sb in FIG. 3, the medium S is easily bent when buckled, and thus a jam of the medium S is apt to occur.

The buckling condition of a member illustrated in FIG. 4 is expressed by the following expression (1).

$$P=\pi^2 \cdot E \cdot I/L^2 \quad (1)$$

In the expression, P is a buckling load (force) [N], E is a coefficient of longitudinal elasticity [GPa], I is a second moment of area [$m^4$], and L is a length of the member [m].

As illustrated in FIG. 5, when the medium S is fed, a length L in the conveying direction, which is in the region R upstream of the nip region N, corresponds to the length of the member L in the expression (1), in the case of considering the buckling of the medium S. In order to enhance the convenience of the image reading apparatus 100 and the like, it is preferable that a large number of media S be placed on the chute 1. On the other hand, when the number of media S placed on the chute 1 is large, the space R1 is enlarged, and the length L associated with the buckling of the fed medium S is increased. As understood from the above expression (1), when the length L associated with buckling, i.e., the length L of the member in the expression (1), is large, buckling is apt to occur under a small load, and there is a problem in that a jam of the medium S is apt to occur.

The medium supply device 111 according to this embodiment includes a movable blocking portion 21 which blocks the space R1 when viewed in the axial direction of the pick roller 6, as illustrated in FIG. 6. Accordingly, a jam of the medium S in the upstream side region R can be suppressed. Further, the medium supply device 111 according to this embodiment includes a movable curve-forming portion 13 which presses the conveyed medium S against the pick roller 6 side so as to be curved. Accordingly, a jam of the medium S in the nip region N can be suppressed.

As illustrated in FIG. 7, the medium supply device 111 according to the embodiment includes a first arm 10 and a second arm 20. The first arm 10 and the second arm 20 are rotationally supported by the respective shafts parallel to the rotating shaft of the pick roller 6. In this embodiment, a center axis line X1 of the rotating shaft of the first arm 10 and a center axis line X2 of the rotating shaft of the second arm 20 are different from each other. In this embodiment, the center axis line X1 of the first arm 10 is positioned on the upstream side in the conveying direction in relation to the center axis line X2 of the second arm 20. In addition, the center axis line X1 of the first arm 10 is at a position farther from a conveying path B of the medium S than the center axis line X2 of the second arm 20. The first arm 10 and the second arm 20 are rotationally supported in the end part on the downstream side in the conveying direction and extend toward the upstream side in the conveying direction from the center axis lines X1 and X2, respectively. The first arm 10 and the second arm 20 are disposed on the brake roller 7 side in relation to the conveying path B of the medium S.

FIG. 8 illustrates a diagram viewed from the direction of the arrow A in FIG. 7. As disclosed in FIG. 8, the first arm 10 includes two first-arm units 11 and 12. The medium supply device 111 of this embodiment includes the two pick rollers 6, the two brake rollers 7, the two first-arm units 11 and 12, and the single second arm 20. The two pick rollers 6 are coaxially disposed and are disposed to have the first-arm units 11 and 12 and the second arm 20 interposed therebetween in the axial direction. Similarly, the two brake rollers 7 are coaxially disposed and are disposed to have the first-arm units 11 and 12 and the second arm 20 interposed therebetween in the axial direction. The two first-arm units 11 and 12 are disposed to have the second arm 20 interposed therebetween in the axial direction. In the following description, in a case where the two first-arm units 11 and 12 are not particularly distinguished from each other, they are simply referred to as the first arm 10.

As illustrated in FIG. 7, the first arm 10 includes the curve-forming portion 13. The curve-forming portion 13 presses the medium S fed by the pick roller 6 against the pick roller 6 side so that the medium S is curved. The first arm 10 is curved to be convex toward the pick roller 6 from the brake roller 7 when viewed in the axial direction, i.e., a direction orthogonal to the conveying direction, and the curved portion protrudes toward the pick roller 6 side. The part in the first arm 10, which protrudes toward the pick roller 6 side, functions as the curve-forming portion 13. The curve-forming portion 13 has a tapered shape in which the width thereof is reduced from the base side toward the tip end side when viewed in the axial direction. The first arm 10 receives a biasing force in the rotational direction (the clockwise direction in FIG. 7) from a pressure applying spring Sp1 such as a coil spring to press the curve-forming portion 13 against the pick roller 6 side. The curve-forming portion 13 is positioned on the downstream side in the conveying direction in relation to the blocking portion 21 and forms a curve at a part of the medium S, which is positioned on the downstream side of the part pressed by the blocking portion 21, in the conveying direction.

The curve-forming portion 13 presses the medium S interposed between the pick roller 6 and the brake roller 7 against the pick roller 6 side so that the medium S is curved as illustrated in FIG. 9. In this embodiment, the curve-forming portion 13 is disposed between the two pick rollers 6 and forms the curve at the center portion of the medium S in a width direction thereof, i.e., a direction orthogonal to the conveying direction.

The second arm 20 includes the blocking portion 21. As illustrated in FIG. 10, the blocking portion 21 blocks the space R1 when viewed in the axial direction of the pick roller 6. The second arm 20 is curved to be convex toward the pick roller 6 from the brake roller 7 when viewed in the axial direction, and the curved portion protrudes toward the pick roller 6 side. The part in the second arm 20, which protrudes toward the pick roller 6 side, functions as the blocking portion 21. The blocking portion 21 has a tapered shape in which the width thereof is reduced from the base side toward the tip end side when viewed in the axial direction. The second arm 20 receives a biasing force in the rotational direction (the clockwise direction in FIGS. 7 and 10) from a pressure applying spring Sp2 such as coil spring to press the blocking portion 21 against the pick roller 6 side.

The blocking portion 21 blocks the space R1 when viewed in the axial direction and suppresses the medium S from being bent toward the brake roller 7 side. Therefore, the blocking portion 21 can suppress the occurrence of a jam due to the buckling of the medium S. When the medium S is bent toward the brake roller 7 side, the medium S presses the blocking portion 21 against the biasing force of the pressure applying spring Sp2. Therefore, the blocking portion 21 suppresses a bend of the medium S by the biasing force of the pressure applying spring Sp2 and can suppress the occurrence of a jam of the medium S. From the viewpoint of suppressing the bend of the medium S, it is preferable that the blocking portion 21 come into contact with the surface of the medium S fed by the pick roller 6 on the brake roller 7 side.

Figure 11:
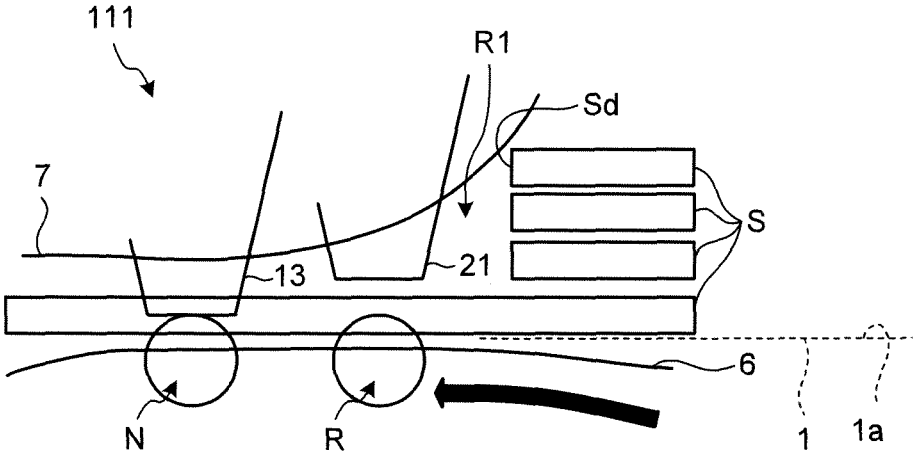
FIG. 11 is a diagram illustrating an example of an effect of suppressing the jam obtained by the medium supply device.

In the medium supply device 111 of this embodiment, the first arm 10 and the second arm 20 are separate members and thus can independently rotate. Therefore, the curve-forming portion 13 and the blocking portion 21 are separate members and can independently move. Accordingly, the suppression of a jam of the medium S in the upstream side region R and the suppression of a jam of the medium S in the nip region N are effectively realized. FIG. 11 is a diagram illustrating an example of an effect of suppressing a jam by the medium supply device 111, and FIG. 12 is a diagram illustrating another example of the effect of suppressing a jam by the medium supply device 111.

FIG. 11 is a diagram illustrating the effect of suppressing a jam in a case where the media S on the placing surface 1*a* of the chute 1 are placed so that ends Sd thereof on the downstream side in the conveying direction are aligned. The blocking portion 21 blocks the space R1 in the axial direction and suppresses a jam of the medium S in the upstream side region R. The blocking portion 21 is movable independently from the curve-forming portion 13. Therefore, even when the curve-forming portion 13 is raised toward the brake roller 7 side by the medium S, the space R1 is appropriately blocked and thus the bend of the medium S can be suppressed. In addition, the curve-forming portion 13 is movable independently from the blocking portion 21. Therefore, even when the blocking portion 21 is raised toward the brake roller 7 side by the medium S, the medium S is appropriately pressed against the pick roller 6 side, and thus the medium S can be curved. That is, the effect of suppressing a jam in the upstream side region R by the blocking portion 21 and the effect of suppressing a jam in the nip region N by the curve-forming portion 13 do not affect each other and the effects are maximally exhibited.

Figure 12:
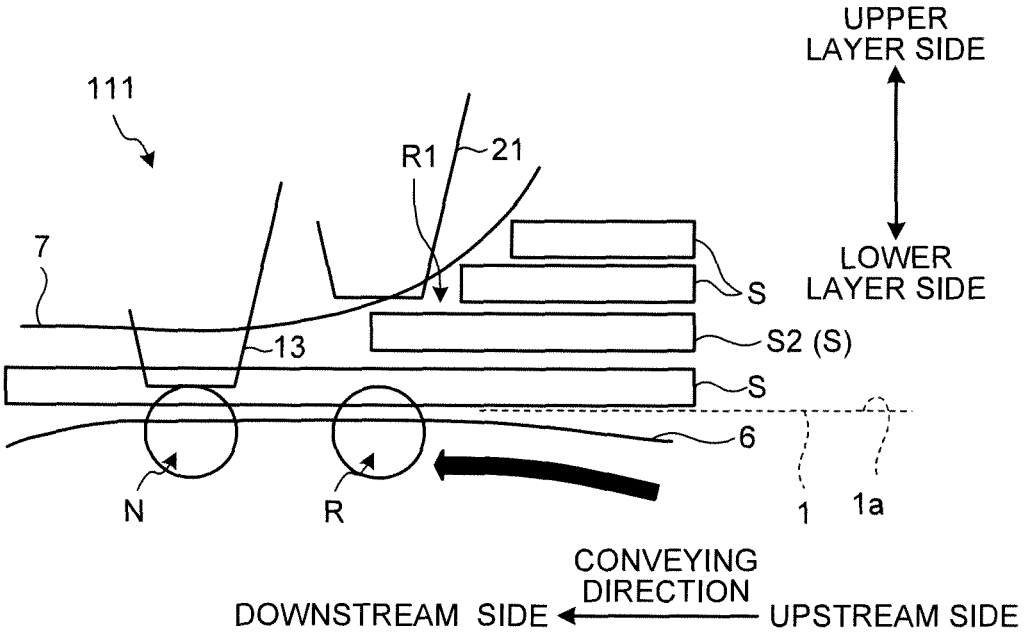
FIG. 12 is a diagram illustrating another example of the effect of suppressing the jam obtained by the medium supply device.

FIG. 12 is a diagram illustrating the effect of suppressing a jam in a case where the media S are piled up on the placing surface 1*a* of the chute 1 with their edges arranged to form a slope, and the media S come into contact with the brake roller 7. As illustrated in FIG. 12, in a case where the media S are stacked so that the media S are positioned on the downstream side in the conveying direction as they go toward the lower layer side, the blocking portion 21 is pressed by a medium S2 to be fed next (the medium S in the next upper layer on the medium S being currently fed) and is raised toward the brake roller 7 side. However, the space R1 is extremely small, and thus a jam of the medium S is less likely to occur in the region R. In addition, the curve-forming portion 13 is movable independently from the blocking portion 21. Therefore, even when the blocking portion 21 is raised toward the brake roller 7 side by the medium S, the medium S is appropriately pressed against the pick roller 6 side, and thus the medium S can be curved. That is, the effect of suppressing a jam in the upstream side region R by the blocking portion 21 and the effect of suppressing a jam in the nip region N by the curve-forming portion 13 are maximally exhibited regardless of a state of sheets piled up.

Regarding the design of the first arm 10 and the second arm 20, it is desirable that each parameter be determined at least from the viewpoint of suppressing a jam. In this embodiment, as described below, in addition to the suppression of a jam, from the viewpoints of suppression of feeding failure of the medium S, suppression of skewing of the medium S, suppression of a split in the medium S, manufacturability, a reduction in cost, and the like, a method of designing each of the arms 10 and 20 is described.

Figure 13:
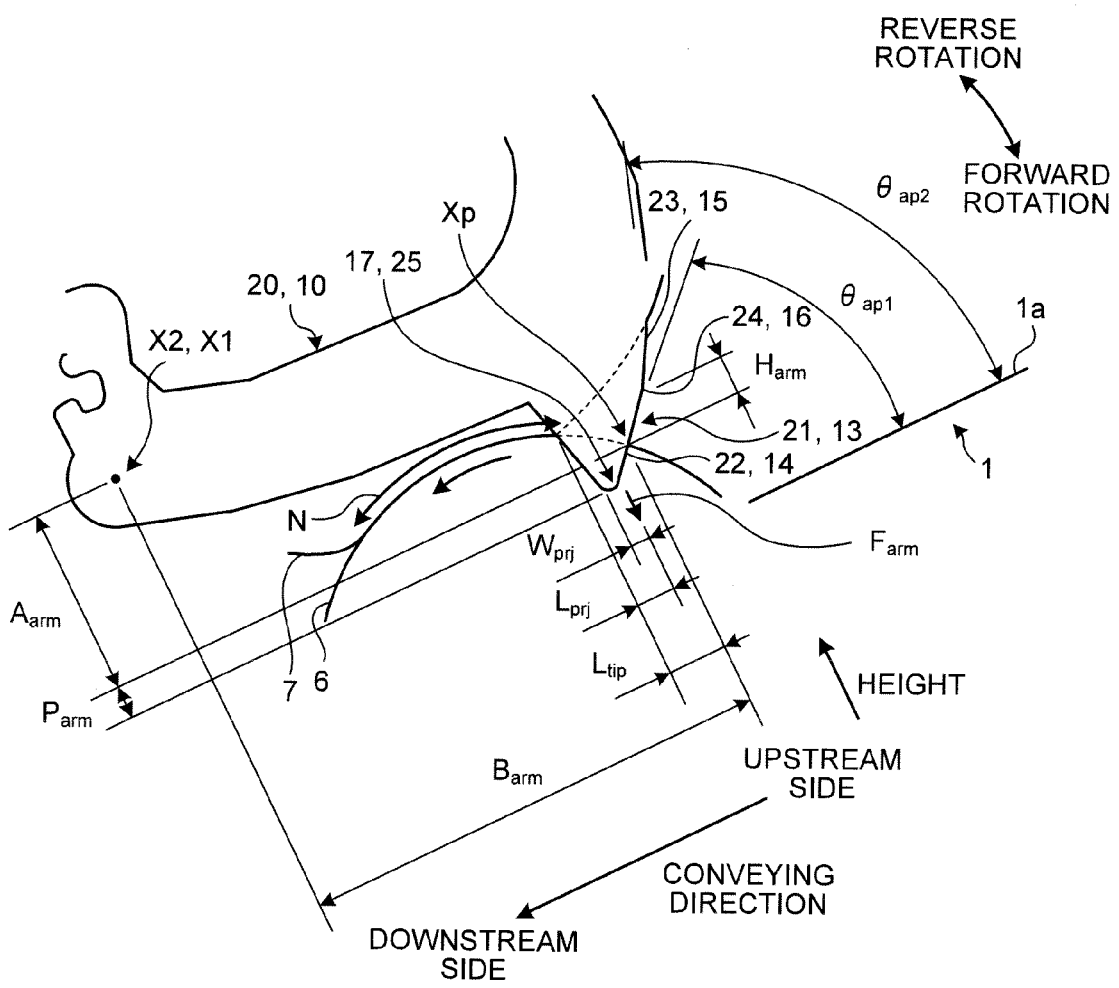
FIG. 13 is a diagram illustrating design parameters of arms.

FIG. 13 is a diagram illustrating design parameters of the arms 10 and 20, and FIG. 14 is a diagram illustrating a list of the design parameters of the arms 10 and 20. In FIG. 13, a lowest point portion 17 of the first arm 10 and a lowest point portion 25 of the second arm 20 are shown. As illustrated in FIGS. 13 and 14, for the arms 10 and 20, 11 parameters including a first angle θap1, a second angle θap2, an arm angle change point height Harm, an arm lowest point depth Parm, an intersection distance Ltip, a lowest point distance Lprj, a lowest point portion width Wprj, a biasing force Farm, a fulcrum position height Aarm, a fulcrum distance Barm, and a friction coefficient μap are set. In FIG. 14, in the fields of related items, numbers of parameters mutually associated are described. For example, in order to determine the first angle θap1, it is desirable to consider the biasing force Farm as the 8th parameter, the fulcrum position height Aram as the 9th parameter, the fulcrum distance Barm as the 10th parameter, and the friction coefficient μap as the 11th parameter.

Further, in FIG. 13, a state where the arms 10 and 20 are positioned closest to the pick roller 6 side (in the clockwise direction) in an allowable rotational range is illustrated. The rotation of the arms 10 and 20 toward the pick roller 6 side is restricted by a stopper (not illustrated). In this specification, regarding the rotational direction of the arms 10 and 20, a rotational direction toward the pick roller 6 side (clockwise in FIG. 13) is referred to as forward rotation, and a rotational direction opposite thereto (counterclockwise in FIG. 13) is referred to as reverse rotation. The arms 10 and 20 receive impelling forces in the forward rotation direction by the pressure applying springs Sp1 and Sp2. In FIG. 13, a state where the arms 10 and 20 abut on the stopper which restricts the rotation in the forward rotation direction.

As illustrated in FIG. 13, a surface in the first arm 10 on the upstream side in the conveying direction includes a first surface 14 and a second surface 15 which have different angles with respect to the conveying direction. That is, the angles of the first surface 14 and the second surface 15 with respect to the fed medium S are different. The first surface 14 is a surface closer to the pick roller 6 than an angle change point 16, and the second surface 15 is a surface on the opposite side to the pick roller 6 side with respect to the angle change point 16. In other words, the surface in the first arm 10 on the upstream side in the conveying direction is bent at the angle change point 16. Similarly, a surface in the second arm 20 on the upstream side in the conveying direction is bent at an angle change point 24, and a surface closer to the pick roller 6 than the angle change point 24 is a first surface 22 and a surface on the opposite side to the pick roller 6 with respect to the angle change point 24 is a second surface 23.

The first angle θap1 is an angle between the first surfaces 14 and 22 and the conveying direction when viewed in the axial direction of the pick roller 6. The second angle θap2 is an angle between the second surfaces 15 and 23 and the conveying direction when viewed in the axial direction of the pick roller 6. The first angle θap1 and the second angle θap2 are 90 degrees in a case where the first surfaces 14 and 22 and the second surfaces 15 and 23 are orthogonal to the conveying direction. In this embodiment, in each of the first arm 10 and the second arm 20, the first angle θap1 is smaller than the second angle θap2. That is, the angle of a surface of the curve-forming portion 13 of the first arm 10 on the upstream side in the conveying direction with respect to the medium S is reduced toward the conveyed medium S. In addition, the angle of a surface of the blocking portion 21 of the second arm 20 on the upstream side in the conveying direction with respect to the medium S is reduced toward the conveyed medium S. That is, the angles of the surfaces of the curve-forming portion 13 and the blocking portion 21 on the upstream side in the conveying direction with respect to the conveying path of the medium S are reduced toward the pick roller 6 side from the brake roller 7 side when viewed in the axial direction. Further, the surfaces of the curve-forming portion 13 and the blocking portion 21 on the upstream side in the conveying direction may have three or more surfaces having different angles with respect to the conveying path when viewed in the axial direction. In this case, it is desirable that the angle with respect to the conveying path viewed in the axial direction be reduced toward the tip ends of the curve-forming portion 13 and the blocking portion 21.

The arm angle change point height Harm represents the height of the angle change points 16 and 24 from an intersection Xp illustrated in FIG. 13. The intersection Xp is a position of intersection between the arms 10 and 20 and the outer peripheral surface of the pick roller 6 when viewed in the axial direction of the pick roller 6, and, in this embodiment, is a position where the surfaces of the arms 10 and 20 on the upstream side in the conveying direction intersect the pick roller 6. In each of the parameters, "height" represents a distance in a direction orthogonal to the conveying direction, and a direction from the pick roller 6 toward the brake roller 7 is defined as a positive direction.

The arm lowest point depth Parm represents a distance (depth) in the height direction from the intersection Xp to the lowest point of the arms 10 and 20. In the first arm 10 of this embodiment, a lowest point portion 17 which is the tip end of the curve-forming portion 13 is at a deepest position in the height direction. In other words, the lowest point portion 17 most protrudes toward the pick roller 6 side from the brake roller 7 side in the first arm 10. The lowest point portion 17 has a function as a pressing portion which comes into contact with the medium S fed by the pick roller 6 and presses the medium S against the pick roller 6 side. The lowest point portion 17 of this embodiment is a flat surface and the ends thereof on the upstream side and the downstream side in the conveying direction are chamfered. Further, the lowest point portion 17 may also have an arc shape when viewed in the axial direction. In the first arm 10, the arm lowest point depth Parm is a distance in the height direction from the intersection Xp to the tip end position of the lowest point portion 17.

In the second arm 20 of this embodiment, a lowest point portion 25 which is the tip end of the blocking portion 21 is at a deepest position in the height direction. That is, the lowest point portion 25 most protrudes toward the pick roller 6 side from the brake roller 7 side in the second arm 20. The lowest point portion 25 has a function as a pressing portion which comes into contact with the medium S fed by the pick roller 6 and presses the medium S toward the pick roller 6 side. The shape of the lowest point portion 25 may be the same as that of the lowest point portion 17. In the second arm 20, the arm lowest point depth Parm is a distance in the height direction from the intersection Xp to the tip end position of the lowest point portion 25.

The intersection distance Ltip is a distance in the conveying direction from the upstream end of the nip region N in the conveying direction to the intersection Xp. The intersection distance Ltip is positive in a case where the intersection Xp is positioned on the upstream side in the conveying direction in relation to the upstream end of the nip region N in the conveying direction, and is negative in a case where the intersection Xp is positioned on the downstream side in the conveying direction in relation to the upstream end of the nip region N in the conveying direction.

The lowest point distance Lprj is a distance in the conveying direction from the upstream end of the nip region N in the conveying direction to the lowest point portions 17 and 25, and in this embodiment, a distance in the conveying direction between the upstream end of the nip region N in the conveying direction and the upstream end of the lowest point portions 17 and 25 in the conveying direction. The lowest point distance Lprj is defined as positive in a case where the upstream end of the lowest point portions 17 and 25 in the conveying direction is positioned on the upstream side in the conveying direction in relation to the upstream end of the nip region N in the conveying direction, and is defined as negative in a case where the upstream end of the lowest point portions 17 and 25 in the conveying direction is positioned on the downstream side in the conveying direction in relation to the upstream end of the nip region N in the conveying direction.

The lowest point portion width Wprj is a width of the lowest point portions 17 and 25 in the conveying direction. The biasing force Farm is a biasing force exerted by the lowest point portions 17 and 25 from the brake roller 7 side toward the pick roller 6 side and is a component force in a direction orthogonal to the conveying direction.

The fulcrum position height Aarm represents a height of the center axis lines X1 and X2 of the rotating shafts of the arms 10 and 20 from the intersection Xp. The fulcrum distance Barm is a distance in the conveying direction from the intersection Xp to the center axis lines X1 and X2 of the rotating shafts of the arms 10 and 20. The friction coefficient μap is a coefficient friction between the surfaces of the arms 10 and 20 on the upstream side in the conveying direction and the medium S.

Jam Suppression

Figure 15:
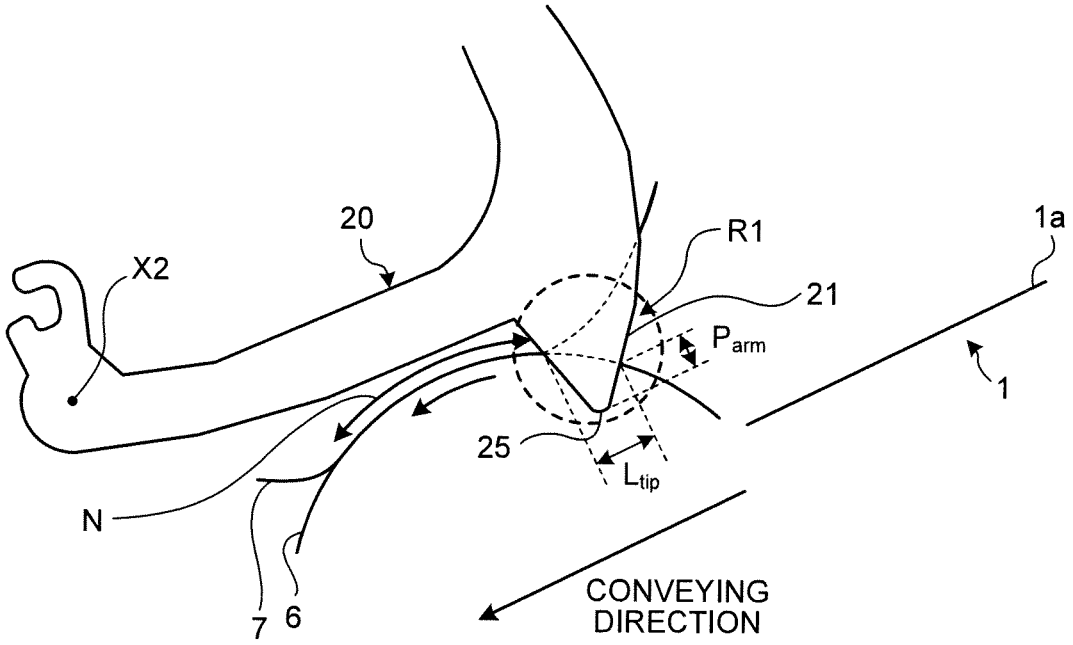
FIG. 15 is a first diagram relating to the design of parameters of the second arm.

First, the design of the arms 10 and 20 will be described from the viewpoint of jam suppression. FIG. 15 is a first diagram associated with the design of the parameters of the second arm 20. It is desirable that the second arm 20 sufficiently block the space R1 positioned on the upstream side in the conveying direction in relation to the nip region N. For this, for example, the intersection distance Ltip needs to have a positive value. The intersection distance Ltip may be determined by a match test so that the bent of the fed medium S can be appropriately suppressed by the blocking portion 21. Further, it is preferable that the biasing force Farm of the second arm 20 have such a value as will prevent the second arm 20 from being raised in a case where the fed medium S is a thin medium S such as thin paper. That is, it is preferable that, when feeding the thin medium S, the medium S passes the second arm 20 while the second arm 20 stays at the farthest position in the forward rotation direction, and when feeding the medium S having a predetermined or greater thickness, the medium S passes the second arm 20 while the second arm 20 is retracted toward the brake roller 7 side being pressed by the medium S. Here, the thin paper is, for example, paper having a ream weight of 17 Kg regarding thickness (a basis weight of 20 g/m$^2$).

Further, it is preferable that the lowest point portion 25 of the second arm 20 overlap the pick roller 6 when viewed in the axial direction of the pick roller 6. That is, it is preferable that the arm lowest point depth Parm of the second arm 20 be positive. The arm lowest point depth Parm may be determined on the basis of a match test or the like.

Figure 16:
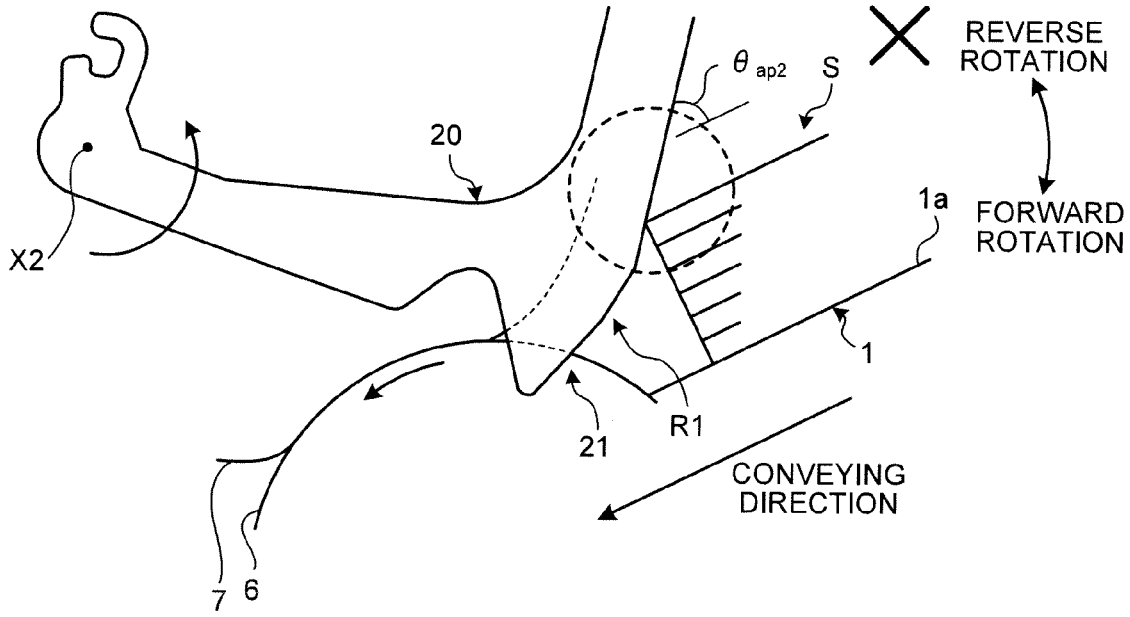
FIG. 16 is an explanatory diagram showing a problem relating to the second arm with undesirable design parameters.
Figure 17:
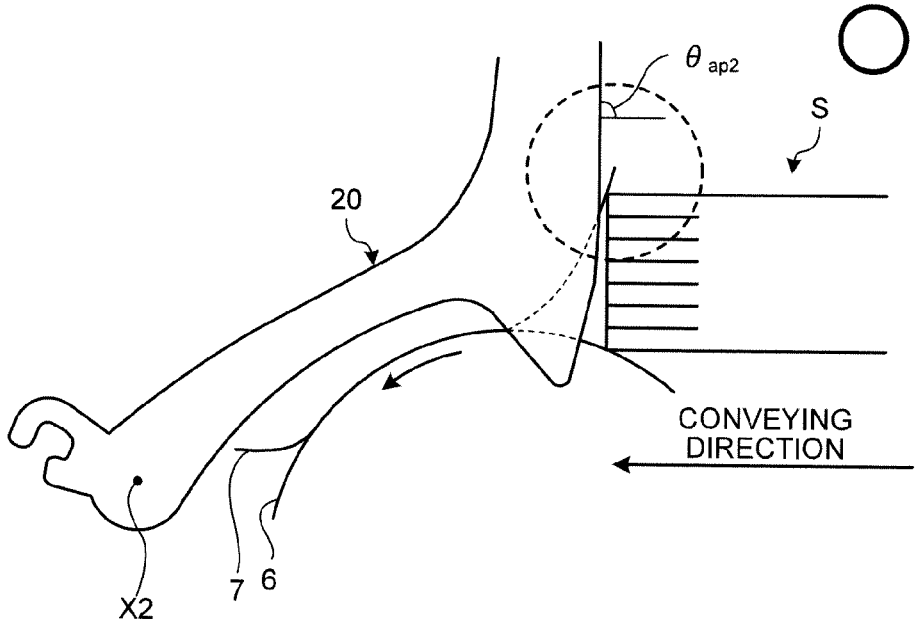
FIG. 17 is a second diagram showing the second arm with desirable design of the parameters.

FIG. 16 is an explanatory diagram of a problem associated with the second arm 20, and FIG. 17 is a second diagram associated with the design of the parameters of the second arm 20. In each of FIGS. 16, 18, 20, 25, 27, 28, and 29, a sign "x" indicates that the figure shows undesirable state, i.e., problematic state. In each of FIGS. 17, 19, 21, 26, and 30, a sign "○" indicates that the figure shows desirable state. It is not preferable that the second arm 20 come into contact with the media S placed on the chute 1 and impede the movement thereof. For example, as illustrated in FIG. 16, when the second angle θap2 is small, there is a possibility that the surface of the second arm 20 on the upstream side in the conveying direction may come into contact with the medium S placed at the upper layer side and impede the rotation of the second arm 20 in the forward rotation direction. Accordingly, there is a possibility that the blocking portion 21 may not sufficiently block the space R1 and reduce the effect of suppressing a jam.

Therefore, it is preferable that the second angle θap2 of the second arm 20 be as large as possible. As illustrated in FIG. 17, it is preferable that the second angle θap2 be determined so that the surface of the second arm 20 on the upstream side in the conveying direction can be rotated to be closest to the forward rotation side without coming into contact with the media S placed. Since the rotation trajectories of the first arm 10 and the second arm 20 are set so as not to interfere with the media S placed on the chute 1, the rotation of the first arm 10 and the second arm 20 can be prevented from being impeded by the media S placed.

Figure 18:
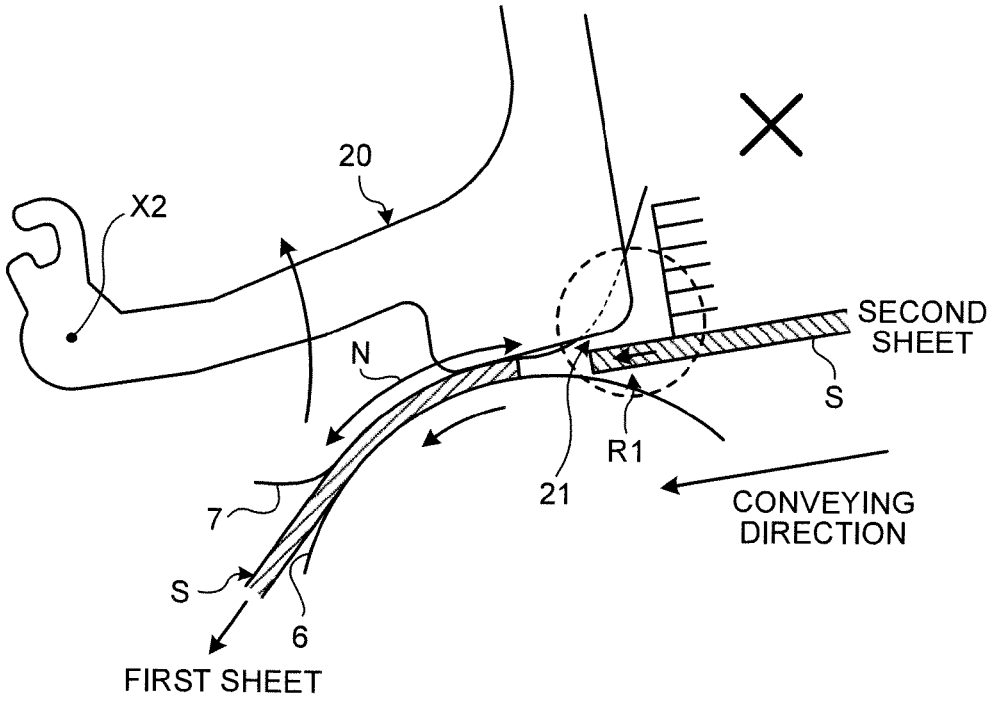
FIG. 18 is an explanatory diagram showing another problem relating to the second arm.
Figure 19:
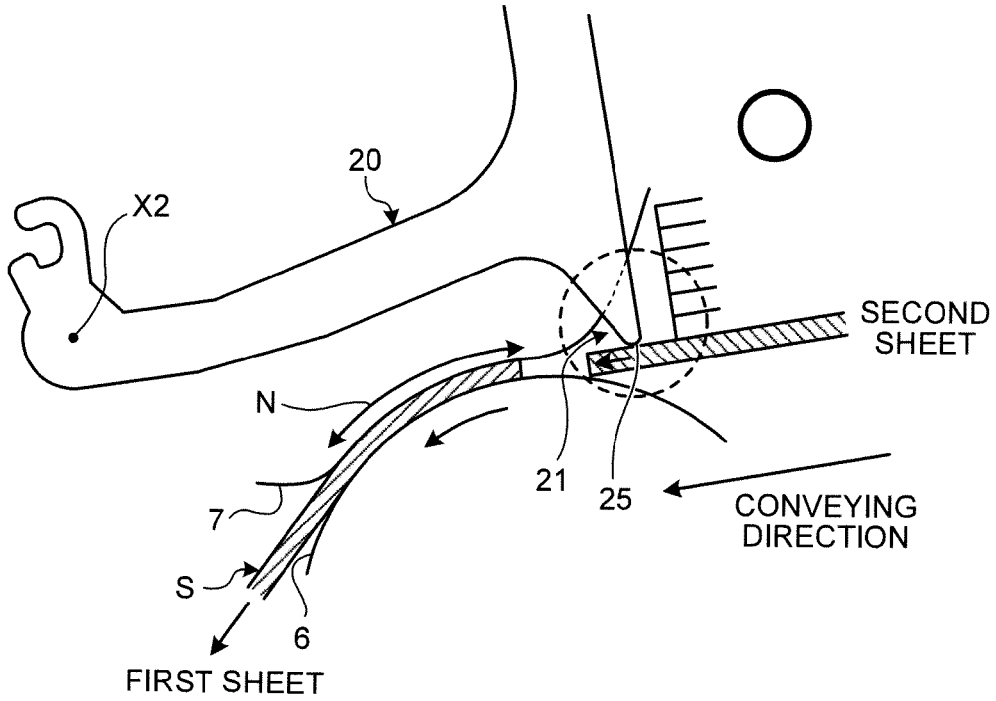
FIG. 19 is a third diagram showing the second arm with desirable design of the parameters.

FIG. 18 is an explanatory diagram of another problem associated with the second arm 20, and FIG. 19 is a third diagram associated with the design of the parameters of the second arm 20. When the second arm 20 is in a state of being raised by the medium S that is previously fed, there is a possibility that the space R1 may not be sufficiently blocked from the medium S to be fed next. As illustrated in FIG. 18, while the second arm 20 is raised toward the brake roller 7 side by the rear end of the first medium S that is previously fed, when the second medium S is fed, the blocking portion 21 cannot sufficiently block the space R1 and there is a possibility that the effect of suppressing a jam on the second medium S may be reduced. When the blocking portion 21 comes into contact with the medium S in the nip region N, the blocking portion 21 is in the state of being raised by the medium S, and thus the effect of blocking the space R1 is apt to be degraded.

In order to solve these problems, it is preferable that the lowest point portion 25 of the second arm 20 do not come into contact with a part of the medium S in the nip region N. For example, as illustrated in FIG. 19, it is preferable that the lowest point portion 25 of the second arm 20 be positioned on the upstream side in the conveying direction in relation to the nip region N and do not overlap the nip region N in the conveying direction. In addition, it is preferable that a period of time in which the second arm 20 is raised by the medium S be shortened by reducing the lowest point portion width Wprj of the second arm 20.

Biasing Force and the Like of First Arm 10

In order to suppress a jam of the medium S, it is desirable that the first arm 10 sufficiently forms the curve at the medium S. It is preferable that the first arm 10 and the pressure applying spring Sp1 are set to cause the biasing force Farm of the first arm 10 to be a predetermined biasing force or higher. It is preferable that the predetermined biasing force be so great that, in a case where the thin medium S such as thin paper is fed, the first arm 10 is not raised by the medium S. Further, it is preferable that the lowest point portion 17 of the first arm 10 overlap the pick roller 6 when viewed in the axial direction of the pick roller 6. That is, it is preferable that the arm lowest point depth Parm of the first arm 10 be greater than 0 (zero). In this embodiment, the rotational range of the first arm 10 includes a position where the lowest point portion 17 overlaps the pick roller 6 when viewed in the axial direction. Therefore, the medium S can be sufficiently curved by the curve-forming portion 13. In addition, it is preferable that the lowest point portion 17 overlap the nip region N in the conveying direction so as to press the part of the medium S in the nip region N. For example, in the conveying direction, the entirety of the lowest point portion 17 may be included in the nip region N.

Suppression of Feeding Failure

Figure 20:
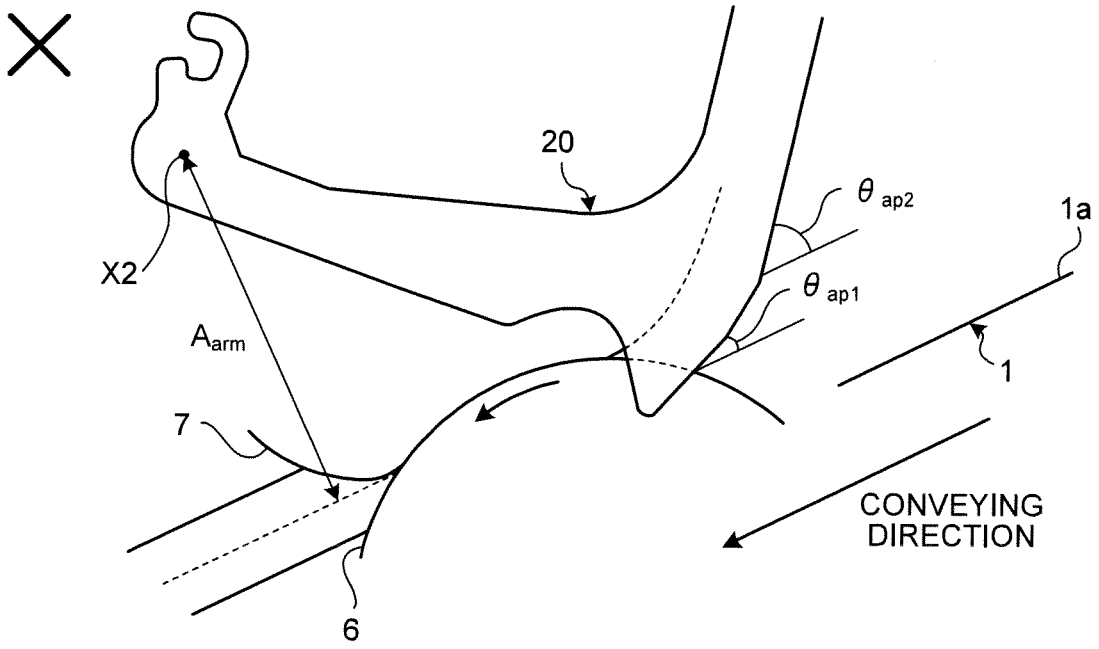
FIG. 20 is an explanatory diagram showing another problem relating to the second arm.
Figure 21:
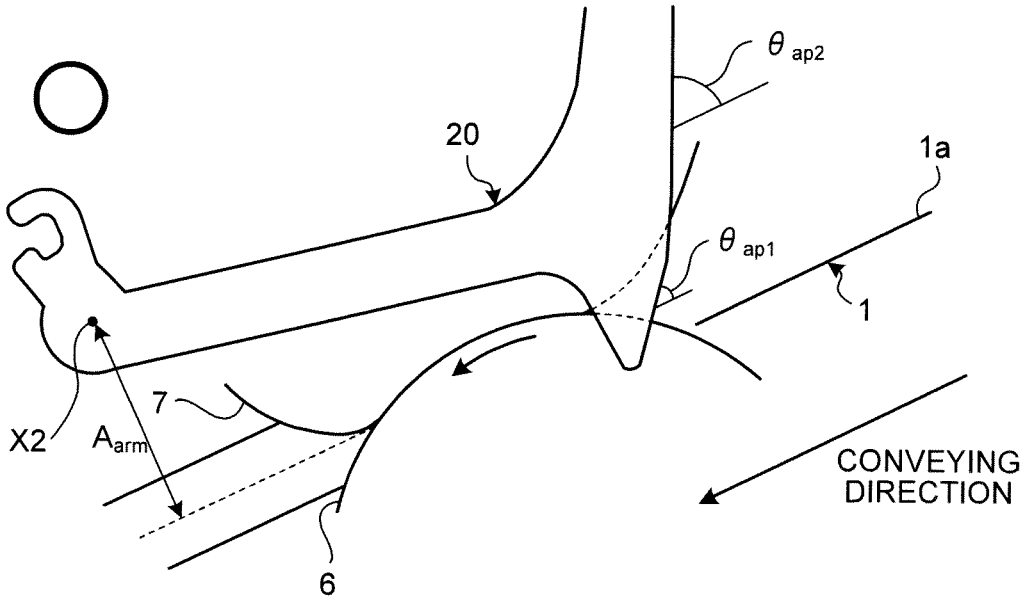
FIG. 21 is a fourth diagram showing the second arm with desirable design of the parameters.
Figure 22:
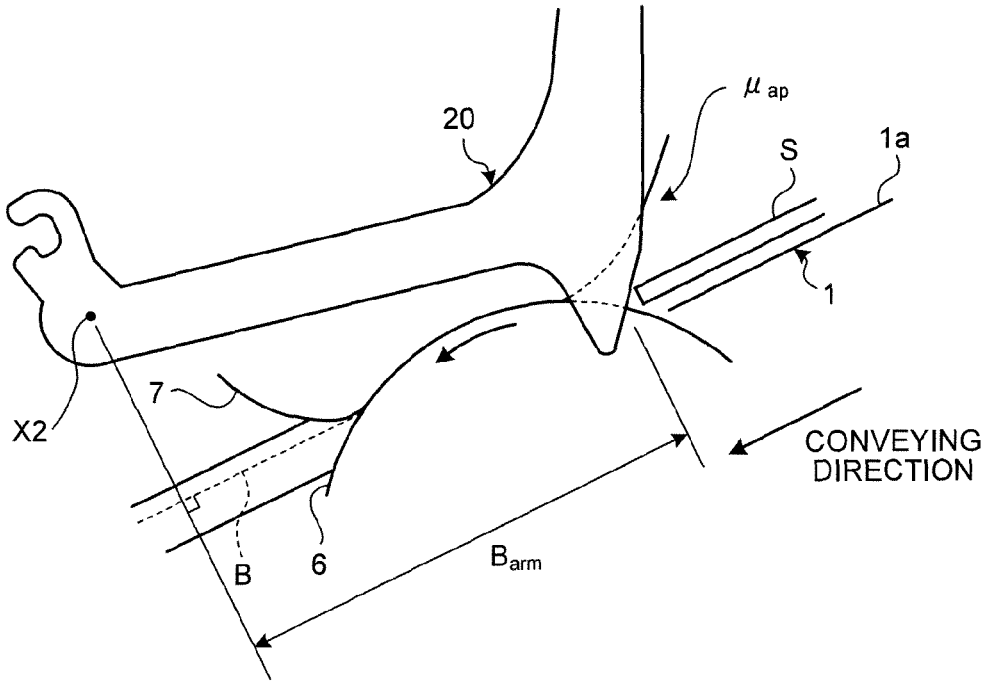
FIG. 22 is a fifth diagram showing the second arm with desirable design of the parameters.

Next, the suppression of feeding failure of the medium S will be described. When the raising characteristics of the second arm 20 are not ensured to a certain degree, there is a possibility that feeding failure may occur due to the second arm 20. In a case of a medium S having high deformability, such as thin paper, even when the second arm 20 is not raised, the medium S deforms (curves) and avoids the second arm 20 such that feeding failure is suppressed. On the other hand, in a case of a medium S having low deformability, when the second arm 20 is not raised, movement in the conveying direction is suppressed by the second arm 20, and thus there is a possibility that feeding failure may occur FIG. 20 is an explanatory diagram of another problem associated with the second arm 20, FIG. 21 is a fourth diagram associated with the design of the parameters of the second arm 20, and FIG. 22 is a fifth diagram associated with the design of the parameters of the second arm 20. In FIG. 20, the second arm 20 having a large fulcrum position height Aarm is illustrated. In this case, as illustrated with reference to FIG. 23, the first angle θap1 needs to be small.

Figure 23:
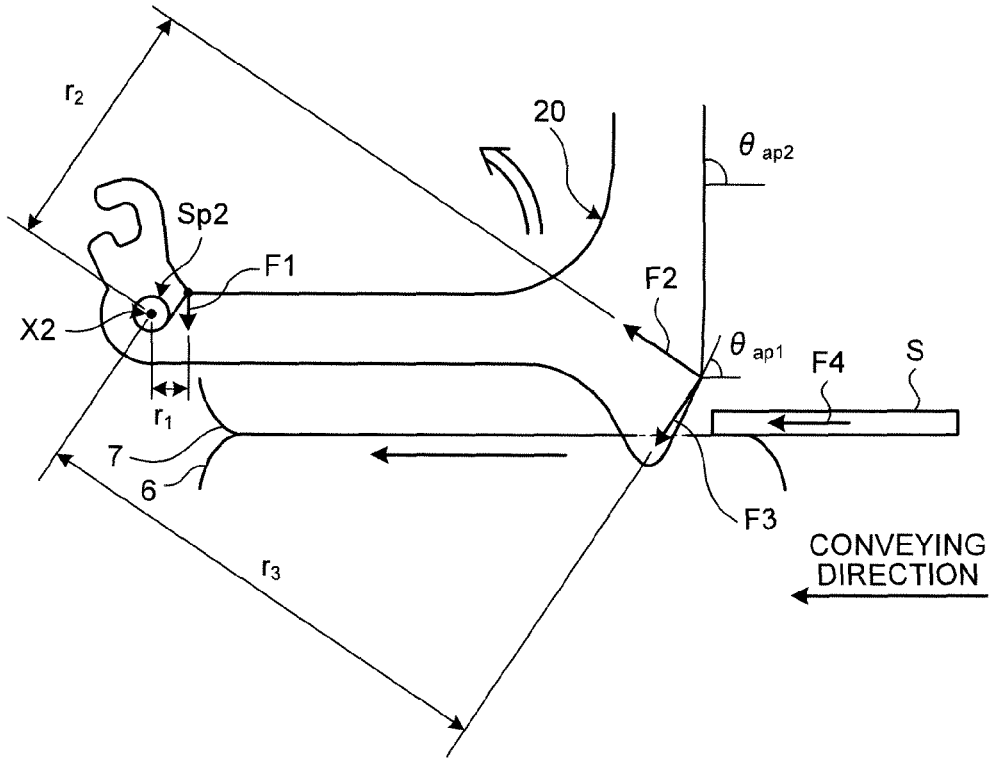
FIG. 23 is a diagram illustrating a force exerted around a center axis line of the second arm.

FIG. 23 is a diagram illustrating a force exerted around the center axis line X2 of the second arm 20. A pick-conveyance force F4 is exerted on the medium S by the pick roller 6. On the second arm 20, an impelling force F1 by the pressure applying spring Sp2, a raising force F2 by the medium S, and a frictional force F3 by the medium S are exerted. The raising force F2 is expressed by the following expression (2). In addition, the frictional force F3 is expressed by the following expression (3).

$$F2=F4\cdot\sin\theta ap1 \quad (2)$$

$$F3=F2\cdot\mu ap \quad (3)$$

A condition in which the second arm 20 is raised toward the brake roller 7 side by the medium S satisfies the following expression (4).

$$F1\cdot r1+F3\cdot r3<F2\cdot r2 \quad (4)$$

In order to enhance the raising characteristics of the second arm 20, it is preferable that the raising force F2 and a radius r2 associated with the raising force F2 be large. For this, reducing the first angle θap1 may be considered. However, when the first angle θap1 is reduced, there is a possibility that the blocking portion 21 may not sufficiently block the space R1. That is, there is a trade-off with the effect of suppressing a jam. In contrast, as illustrated in FIG. 21, when the fulcrum position height Aarm is reduced, the raising characteristics of the second arm 20 are enhanced even when the first angle θap1 is the same. That is, it is preferable that the rotation fulcrum position of the second arm 20 be positioned on the downstream side in the conveying direction in relation to an inlet of the nip region N in the conveying direction. In addition, it is preferable that the rotation fulcrum position of the second arm 20 be positioned on the brake roller 7 side in relation to the conveying path B and be adjacent to the conveying path B.

Further, as illustrated in FIG. 22, by increasing the fulcrum distance Barm, the radius r2 associated with the raising force F2 is increased, and thus the above expression (4) can be easily achieved. Moreover, by reducing the friction coefficient μap between the second arm 20 and the medium S, the above expression (4) can be easily achieved.

Figure 24:
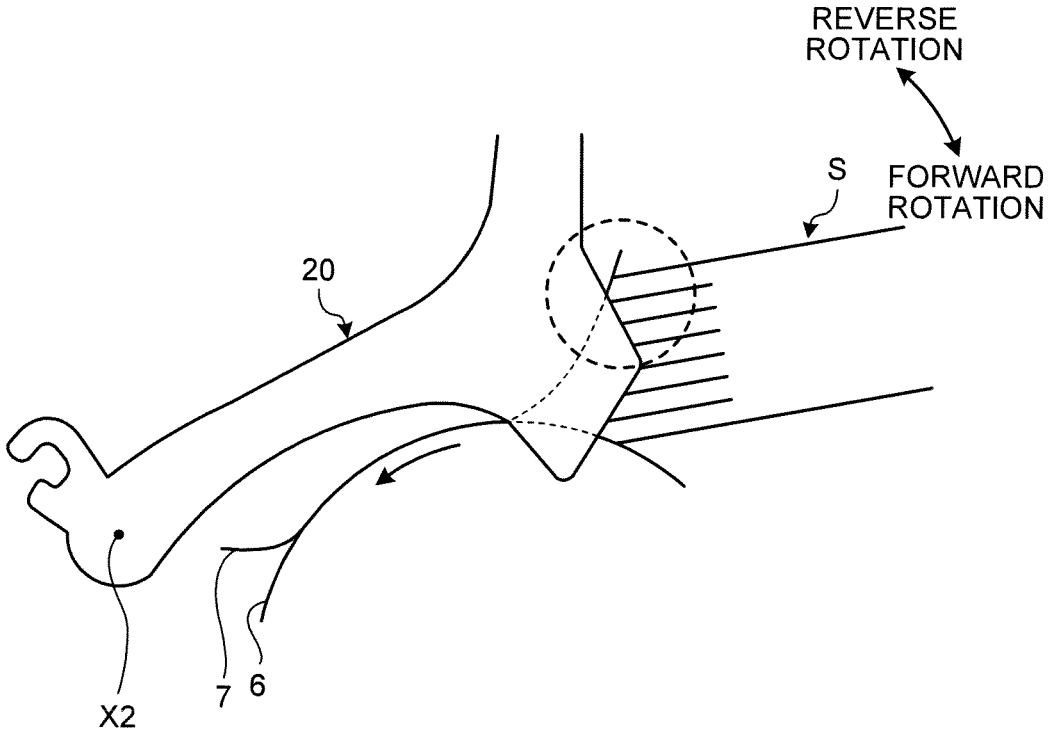
FIG. 24 is an explanatory diagram showing another problem associated with the second arm.
Figure 25:
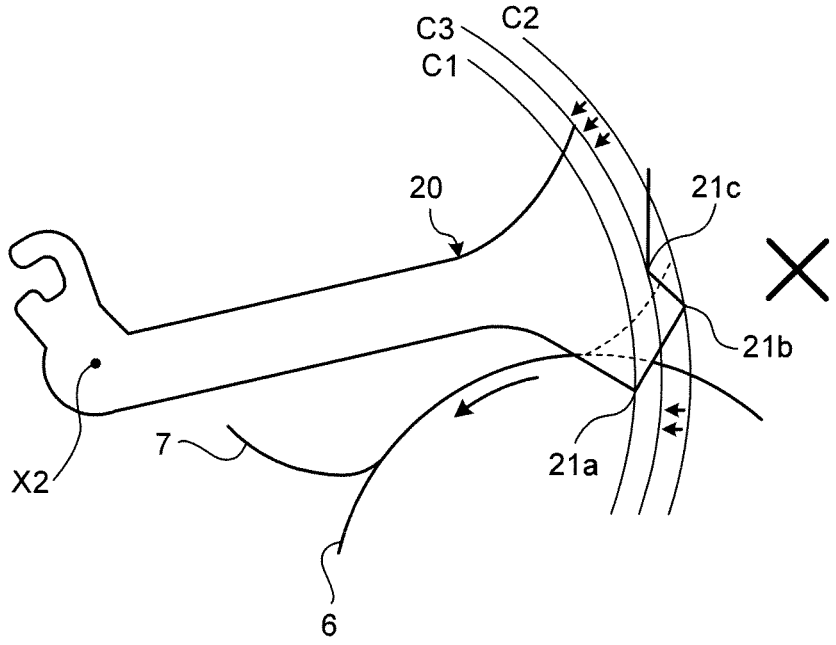
FIG. 25 is a diagram illustrating the second arm having a shape which is apt to cause feeding failure.
Figure 26:
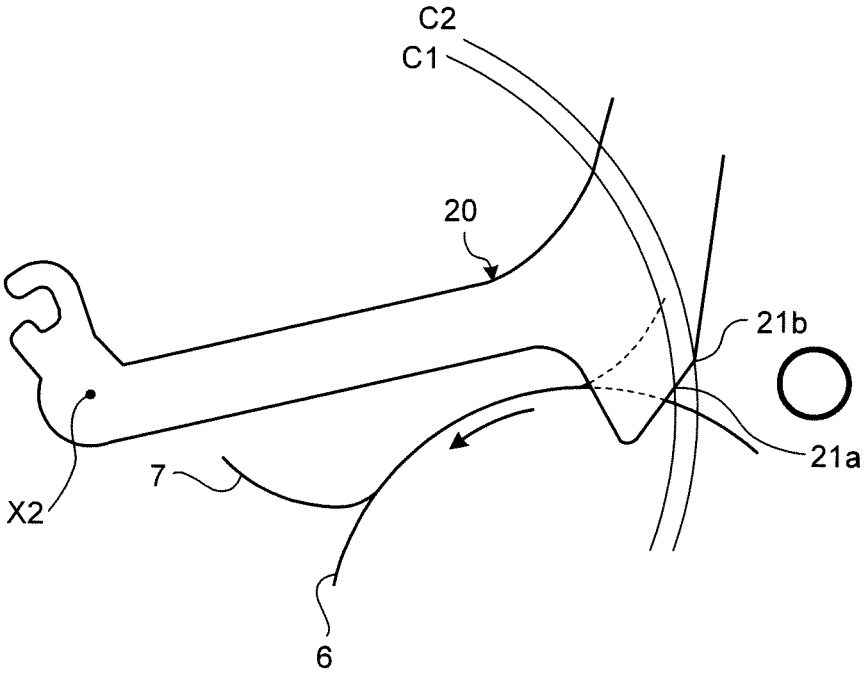
FIG. 26 is a sixth diagram showing the second arm with desirable design of the parameters.

FIG. 24 is an explanatory diagram of another problem associated with the second arm 20, FIG. 25 is a diagram illustrating a shape of the second arm 20 by which feeding failure is apt to occur, and FIG. 26 is a sixth diagram associated with the design of the parameters of the second arm 20. As illustrated in FIG. 24, when the rotation of the second arm 20 is restricted by the media S stacked on the chute 1, a transport load of the medium S is increased. In the second arm 20 illustrated in FIG. 24, the medium S at the upper layer is placed on the second arm 20, and thus the rotation of the second arm 20 in the reverse rotation direction is restricted. Accordingly, in order for the fed medium S to push up the second arm 20, a large pick-conveyance force F4 is necessary, and the transport load is increased. Therefore, feeding failure is apt to occur.

An arm shape which is apt to cause feeding failure will be described with reference to FIG. 25. In FIG. 25, a rotation trajectory C1 is a trajectory of a first point 21*a* of the blocking portion 21, a rotation trajectory C2 is a trajectory of a second point 21*b* of the blocking portion 21, and a rotation trajectory C3 is a trajectory of a third point 21*c* of the blocking portion 21. The first point 21*a*, the second point 21*b*, and the third point 21*c* are points positioned on the surface on the upstream side in the conveying direction. The third point 21*c* is a point further from the pick roller 6 in the height direction than the second point 21*b*, but the rotation trajectory C3 is positioned on the inner side in relation to the rotation trajectory C2 of the second point 21*b*. Accordingly, the medium S is placed in a region between the second point 21*b* and the third point 21*c*, and thus rotation is apt to be impeded.

In contrast, as the surface of the second arm 20 of the embodiment illustrated in FIG. 26, which is on the upstream side in the conveying direction, goes away from the pick roller 6, the rotation trajectories are positioned on the outer side in the radial direction. In FIG. 26, even when the second point 21*b* which is further from the pick roller 6 from the first point 21*a* in the height direction is any point, the rotation trajectory C2 thereof is positioned on the outer side in relation to the rotation trajectory C1 of the first point 21*a*. Accordingly, the restriction on the rotation of the second arm 20 by the medium S placed on the second arm 20 can be suppressed.

Figure 27:
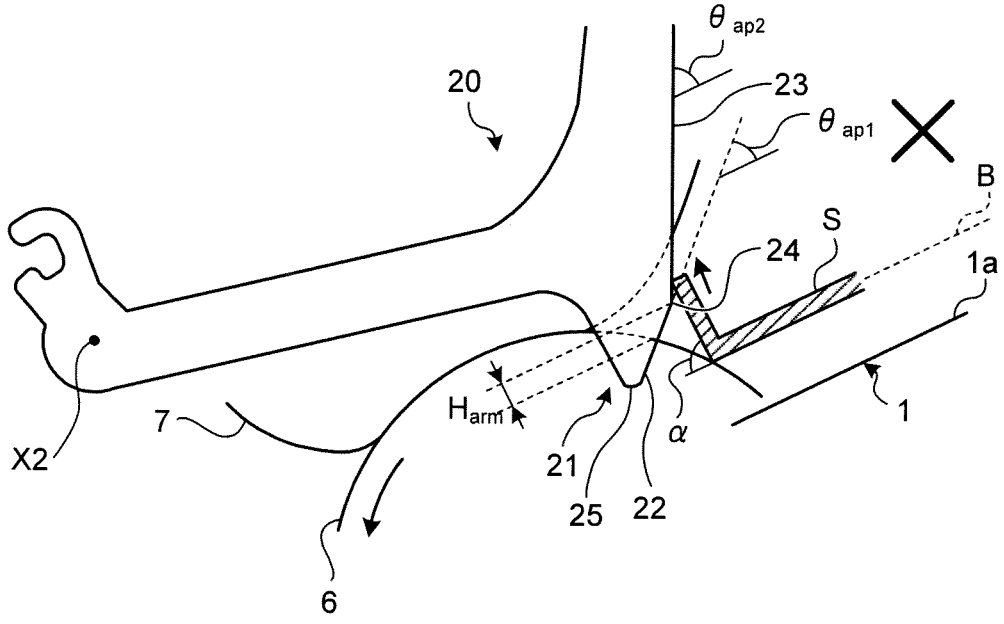
FIG. 27 is an explanatory diagram showing another problem associated with the second arm.
Figure 28:
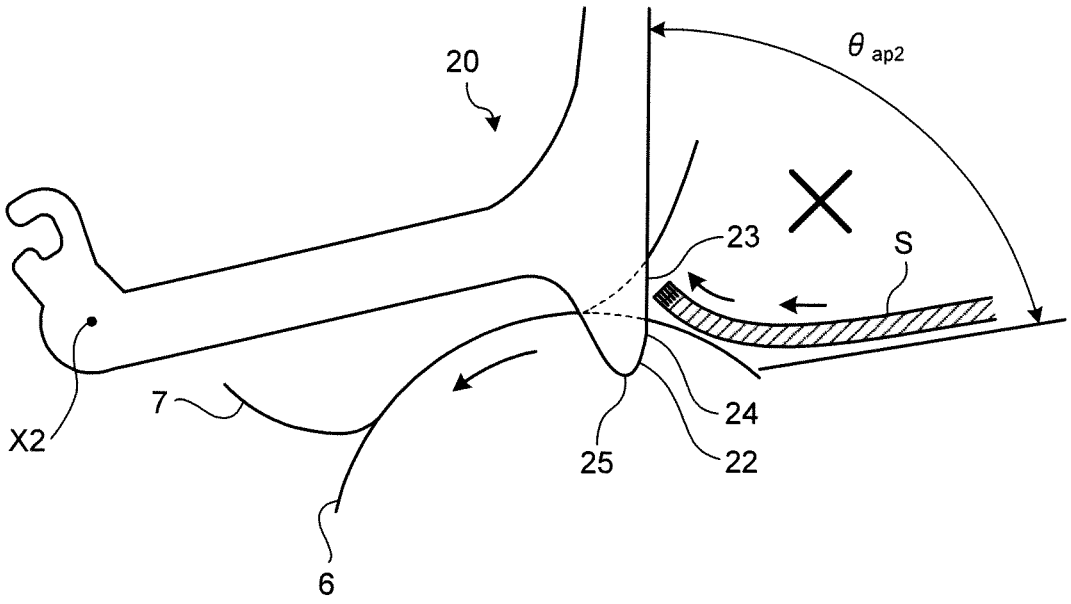
FIG. 28 is an explanatory diagram showing another problem associated with the second arm.

FIG. 27 is an explanatory diagram of another problem associated with the second arm 20, and FIG. 28 is an explanatory diagram of another problem associated with the second arm 20. The end portion of the medium S illustrated in FIG. 27, which is on the downstream side in the conveying direction, is curled toward the brake roller 7 side. In a case of the medium S which is curled with a small radius, an upward angle α of the tip end portion thereof is increased. However, the tip end portion is not much curled, the height from the conveying path B to the tip end portion is small. On the other hand, in a case of a medium S which is curled with a large radius, an upward angle α of the tip end portion thereof is reduced. However, the height from the conveying path B to the tip end portion is increased. Here, as illustrated in FIG. 27, in a case where the medium S which is curled with a small radius abuts on the second surface 23 and the second angle θap2 is large, the medium S which is curled with the small radius moves toward the brake roller 7 and feeding failure is apt to occur. In addition, as illustrated in FIG. 28, in a case where the medium S which is curled with a large radius abuts on the second surface 23 and the second angle θap2 is large, the medium S which is curled with the large radius moves toward the brake roller 7 side and feeding failure is apt to occur.

Here, by appropriately setting the arm angle change point height Harm, feeding failure can be suppressed. In the second arm 20 of this embodiment, the first angle θap1 is smaller than the second angle θap2. The arm angle change point height Harm is set so that the first surface 22 abuts on the tip end portion of the medium S which is curled with a small radius and the second surface 23 abuts on the tip end portion of the medium S which is curled with a large radius. For example, as illustrated in FIG. 27, since the arm angle change point height Harm is set so that the first surface 22 abuts on the medium S which is slightly curled as illustrated in FIG. 27, the tip end portion of the medium S is guided to the lowest point portion 25 along the first surface 22.

In addition, the tip end portion of the medium S which is curled with a large radius as illustrated in FIG. 28 abuts on the second surface 23. Regarding this, by appropriately setting the second angle θap2 of the second surface 23, the tip end portion of the medium S is guided to the first surface 22 along the second surface 23 and is further guided to the lowest point portion 25 along the first surface 22. In this manner, by appropriately setting the first angle θap1, the second angle θap2, and the arm angle change point height Harm, the tip end portion of the medium S is guided to the lowest point portion 25 regardless of the curling radius of the medium S, and thus it is possible to suppress feeding failure.

Furthermore, in order to suppress feeding failure, it is desirable that the pick-conveyance force F4 be appropriately determined. The pick-conveyance force F4 by the pick roller 6 may be ensured so as to satisfy the condition of the above expression (4).

Suppression of Skewing

Next, the suppression of skewing of the medium S will be described. A medium S having a large thickness easily skews. For example, when the pick-conveyance force F4 needed to satisfy the above expression (4) is too high, skewing is apt to occur. It is preferable that the maximum pick-conveyance force F4 be determined to cause a medium S having the maximum performance thickness to raise the second arm 20 toward the brake roller 7 so as to be transported without skewing and the biasing force F1 of the pressure applying spring Sp2 and the like be determined based on the maximum pick-conveyance force F4 and the above expression (4).

Figure 29:
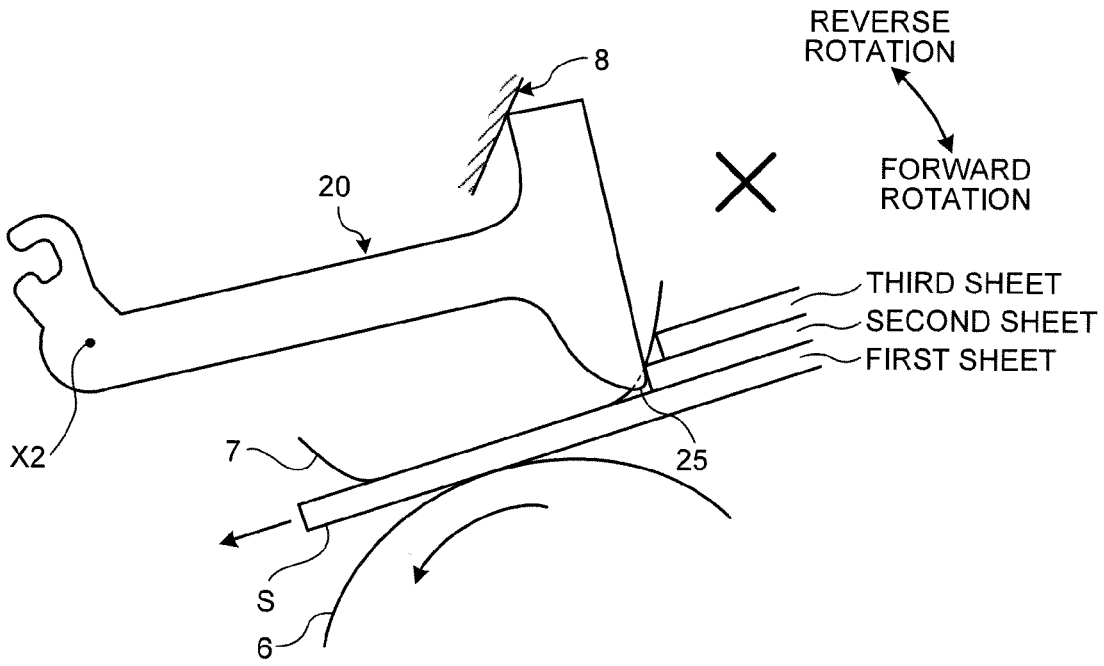
FIG. 29 is an explanatory diagram showing another problem associated with the second arm.
Figure 30:
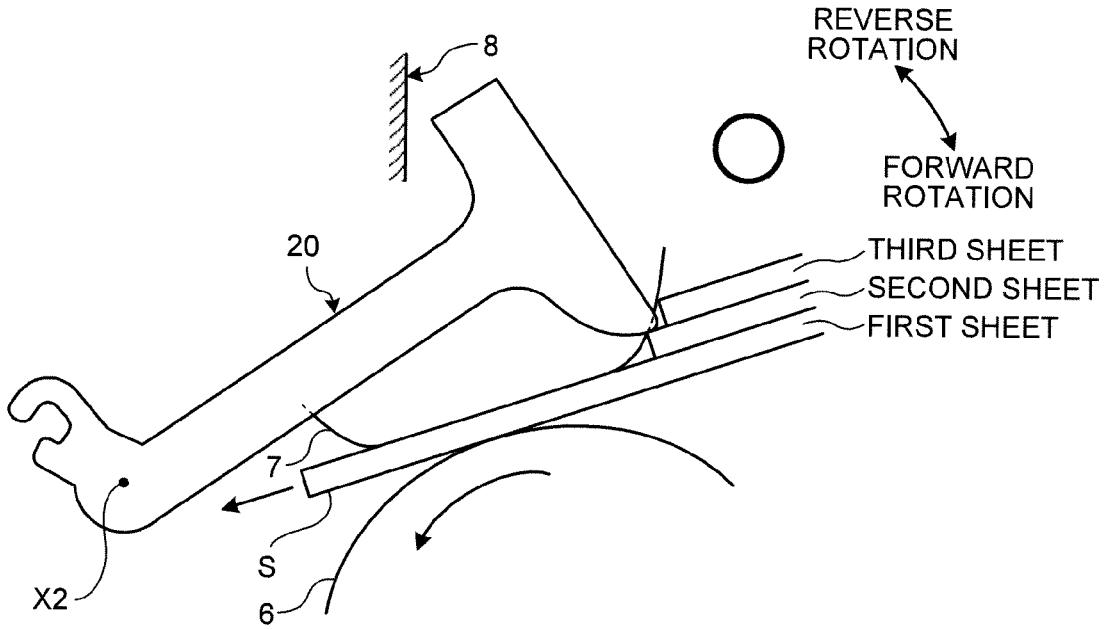
FIG. 30 is a seventh diagram showing the second arm with desirable design of the parameters.

FIG. 29 is an explanatory diagram of another problem associated with the second arm 20, and FIG. 30 is a seventh diagram associated with the design of the parameters of the second arm 20. The rotation of the second arm 20 in the reverse rotation direction is restricted by a stopper 8. The medium S illustrated in FIGS. 29 and 30 is, for example, the medium S having the maximum performance thickness, and as an example, is a resin card having a low friction coefficient.

In the case of the medium S, the second medium S fed next is in an unstable state for the following reasons:

(1) The medium S is interposed between media S having a low friction coefficient and thus easily moves.

(2) Since the first medium S is transported, a force in the conveying direction is received from this medium S.

The center of the tip end of the medium S in the unstable state comes into contact with the second arm 20. At this time, as illustrated in FIG. 29, when the second arm 20 abuts on the stopper 8 and the rotation thereof in the reverse rotation direction is restricted, skewing is apt to occur. The second arm 20 illustrated in FIG. 29 may not rotate in the reverse rotation direction to a position where the second medium S is allowed to pass. Therefore, the second arm 20 may not be raised by the second medium S toward the brake roller 7 and restricts the movement of the second medium S in the conveying direction. As a result, the second medium S is tilted while the first medium S is transported and finally skews.

The second arm 20 of this embodiment allows the second medium S to move in the conveying direction as illustrated in FIG. 30. The second medium S can raise the second arm 20 toward the brake roller 7 in a state where the first medium S and the second medium S overlap, and the second arm 20 do not abut on the stopper 8 in the state of being raised by the second medium S. Therefore, an excessive restriction on the movement of the second medium S by the second arm 20 is suppressed, and thus the occurrence of skewing of the medium S is suppressed.

Suppression of Split

It is desirable that, when a medium S such as a brittle sheet is supplied, a split in the medium S be suppressed. For example, when the biasing force Farm of the first arm 10 or the second arm 20 on the brittle medium S is too high, there is a possibility that the medium S may be split. Further, when the amount of the curve-forming portion 13 protruding toward the pick roller 6 is too large, splitting of the medium S is apt to occur.

In order to suppress a split in the brittle medium S, it is preferable that the biasing force Farm of the first arm 10 and the arm lowest point depth Parm be appropriately determined. In addition, it is preferable that the biasing force Farm and the like be determined so that the second arm 20 is raised by the medium S toward the brake roller 7 to be retracted when the brittle medium S is passed. It is preferable that each of the parameters be determined by a match test in which available brittle media S are used, or the like.

As described above, in the medium supply device 111 according to this embodiment, the second arm 20 having the blocking portion 21 is provided to be rotatable without interfering with the media S placed on the chute 1. Therefore, the second arm 20 can block the space R1 using the blocking portion 21 regardless of the number of media S stacked.

Further, the second arm 20 is disposed to oppose the pick roller 6 with the medium S interposed therebetween and thus can abut on the medium S which starts buckling and further restrict the deformation thereof or can restrict the deformation of the medium S which tries to buckle. It is preferable that the blocking portion 21 of the second arm 20 come into contact with the medium S fed by the pick roller 6. However, the blocking portion 21 may also be disposed with a gap from the medium S.

In addition, the blocking portion 21 is pressed and raised by the medium S fed by the pick roller 6, and thus can be retracted toward the brake roller 7 with respect to the medium S. Therefore, an increase in the transport load of the medium S is suppressed. Moreover, instead of or in addition to retracting by the rotating operation of the second arm 20, the blocking portion 21 may be retracted toward the brake roller 7 with respect to the medium S through deformation. For example, the blocking portion 21 may be elastically deformed by a biasing force from the medium S.

In addition, the center axis lines X1 and X2 of the rotating shafts of the arms 10 and 20 may be positioned on any of the upstream side and the downstream side in the conveying direction in relation to the nip region N, and may be positioned on any of the pick roller 6 side and the brake roller 7 side in relation to the conveying path B of the medium S. Further, the arms 10 and 20 may also be rotationally supported by any of the main body section 100*a* and the rotating section 100*b*.

In addition, in the medium supply device 111 of this embodiment, the first arm 10 and the second arm 20 may be disposed to be shifted from each other in the axial direction so as to rotate without interfering with each other. Therefore, the function of suppressing a jam of media by the blocking portion 21 which blocks the space and a reinforcing mechanism by the curve-forming portion 13 can be maximally exhibited.

First Modification Example of Embodiment

Figure 31:
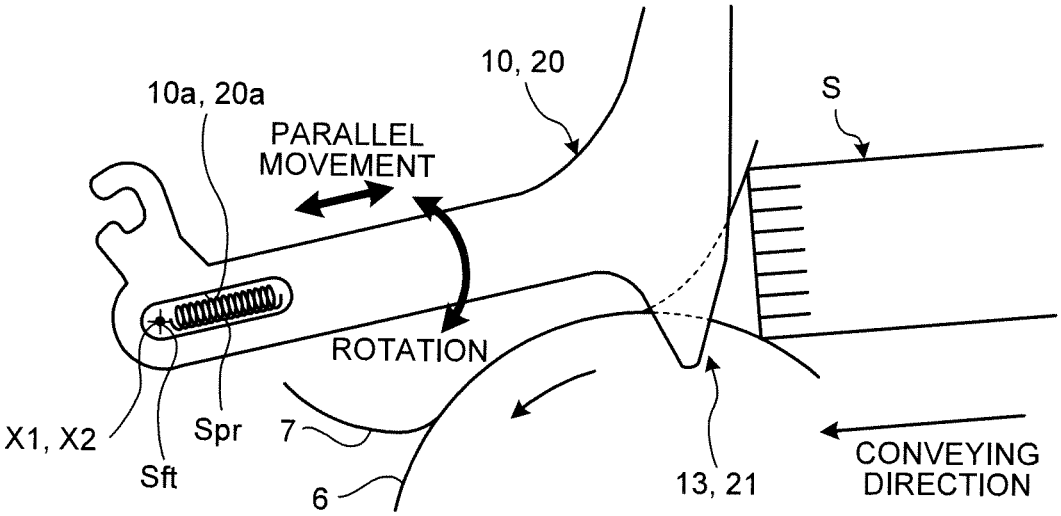
FIG. 31 is a diagram illustrating a schematic configuration of the arms according to a first modification example of the embodiment.

FIG. 31 is a schematic configuration diagram of the arms 10 and 20 according to a first modification example of the embodiment. Regarding the arms 10 and 20 of the first modification example, the arms 10 and 20 can move in parallel to center axis lines X1 and X2 of rotation. That is, the positions of the curve-forming portion 13 and the blocking portion 21 in the radial direction with respect to the center axis lines X1 and X2 are variable. The arms 10 and 20 are respectively provided with long holes 10*a* and 20*a* that extend in the longitudinal directions of the arms 10 and 20. The arms 10 and 20 are rotationally supported by rotating shafts Sft inserted in the long holes 10*a* and 20*a*, respectively. The positions of the rotating shafts Sft in the long holes 10*a* and 20*a* are adjusted by springs Spr. The springs Spr bias the rotating shafts Sft to allow the curve-forming portion 13 and the blocking portion 21 to be positioned closest to the upstream side in the conveying direction.

Accordingly, depending on conditions such as the thickness of a medium S and a way of collapsing of the medium S, the positions of the arms 10 and 20 are automatically adjusted to be optimal. For example, in a case of a thick medium S, the second arm 20 is pressed by the medium S and moves toward the downstream side in the conveying direction. As the blocking portion 21 is moved toward the downstream side in relation to the inlet of the nip region N, it is possible to suppress feeding failure of the medium S. In this case, it is possible to set the biasing force Farm of the second arm 20 to be further increased.

Second Modification Example of Embodiment

Figure 32:
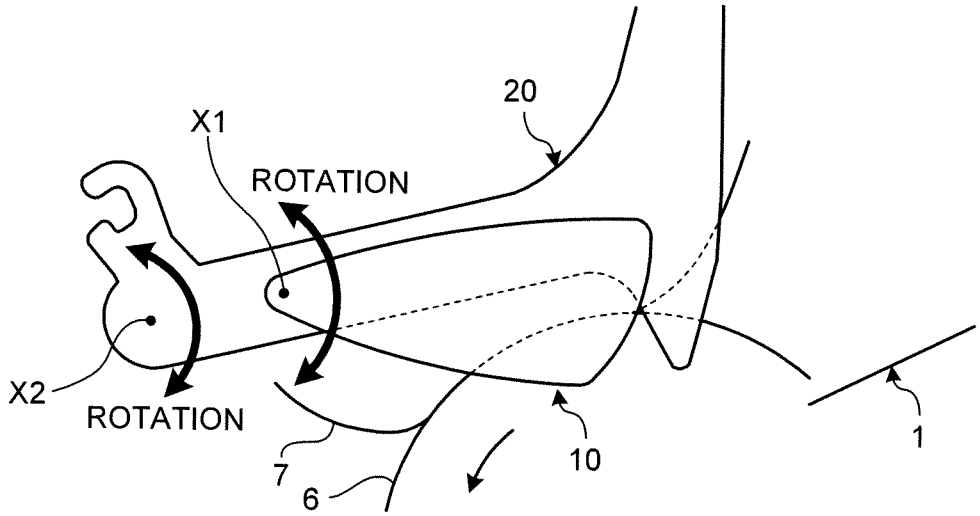
FIG. 32 is a diagram illustrating a schematic configuration of the arms according to a second modification example of the embodiment.

FIG. 32 is a schematic configuration diagram of the arms 10 and 20 according to a second modification example of the embodiment. The first arm 10 of the second modification example is rotationally supported by the second arm 20. Even in this case, the first arm 10 and the second arm 20 can be independently moved. Further, the second arm 20 may also be rotationally supported by the first arm 10.

Third Modification Example of Embodiment

A third modification example of the embodiment will be described. A mechanism of retracting the arms 10 and 20 toward the brake roller 7 may be provided. For example, the medium supply device 111 may be provided with a device which detects the thickness of a medium S, a retraction mechanism which retracts the arms 10 and 20, and a controller which controls the retraction mechanism. The controller allows the second arm 20 to be retracted toward the brake roller 7 by the retraction mechanism in a case where the thickness of the medium S is a predetermined value or higher. Accordingly, both the effect of suppressing curving of the medium S by the blocking portion 21 of the second arm 20 and the effect of suppressing feeding failure and skewing of the thick medium S can be achieved.

Fourth Modification Example of Embodiment

Figure 33:
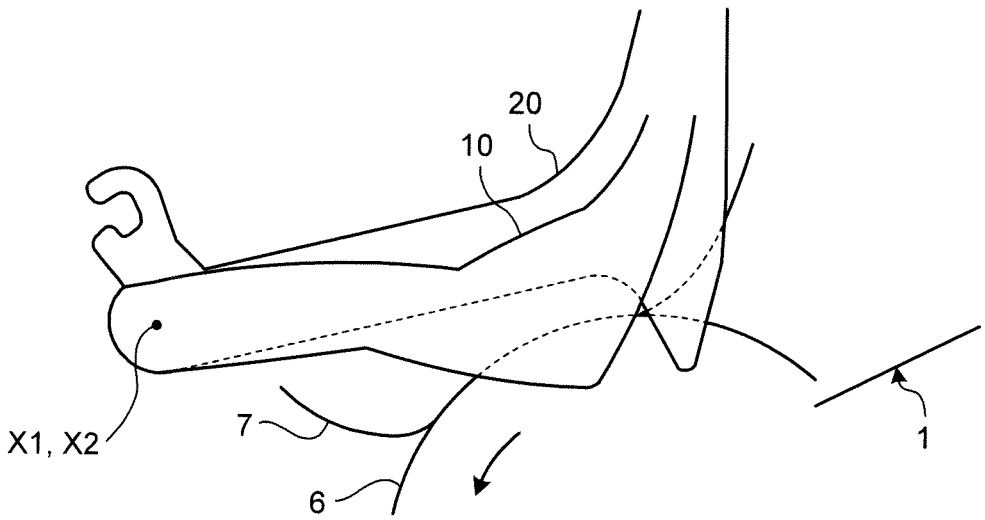
FIG. 33 is a diagram illustrating a schematic configuration of the arms according to a fourth modification example of the embodiment.

FIG. 33 is a schematic configuration diagram of the arms 10 and 20 according to a fourth modification example of the embodiment. As illustrated in FIG. 33, the first arm 10 and the second arm 20 may be supported about the same center axis lines X1 and X2 as their rotation centers.

Fifth Modification Example of Embodiment

Figure 34:
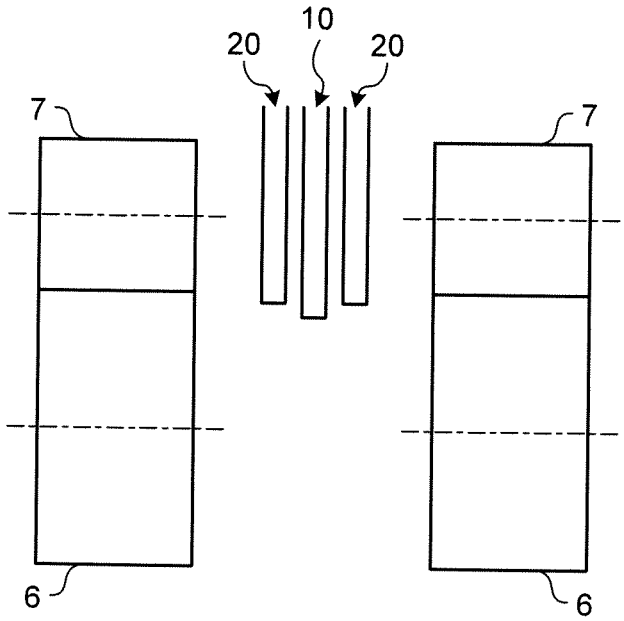
FIG. 34 is a diagram illustrating a schematic configuration of the arms according to a fifth modification example of the embodiment.

FIG. 34 is a schematic configuration diagram of the arms 10 and 20 according to a fifth modification example of the embodiment. In the above-described embodiment, the second arm 20 is interposed between the two first arms 10. However, in reverse, the first arm 10 may also be interposed between the two second arms 20.

Sixth Modification Example of Embodiment

Figure 35:
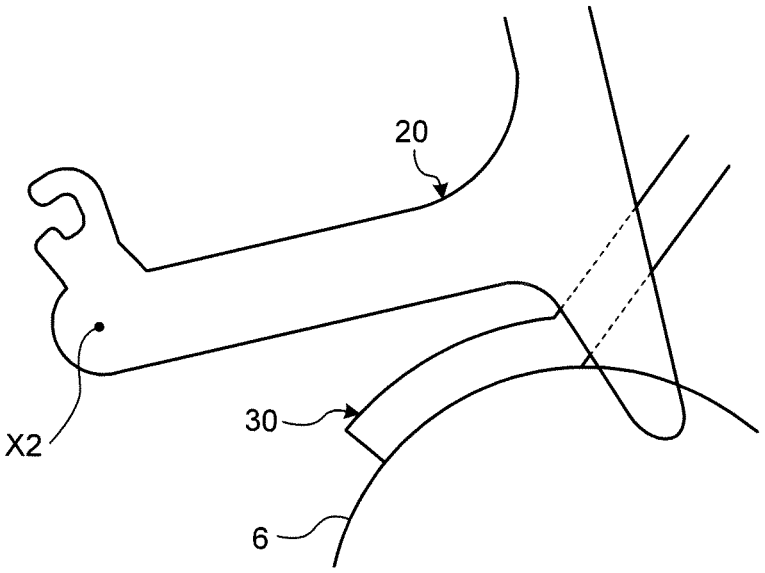
FIG. 35 is a diagram illustrating a schematic configuration of a separating unit according to a sixth modification example of the embodiment.

FIG. 35 is a schematic configuration diagram of the separating unit according to a sixth modification example of the embodiment. The separating unit according to the sixth modification example is a separating pad 30 instead of the brake roller 7 of the above-described embodiment. The separating pad 30 exerts a force in the opposite direction to the conveying direction to the medium S using the frictional force resisting the medium S. Furthermore, the separating unit is not limited to the separating pad, and those exerting a brake force on the medium S may also be employed as the separating unit.

Seventh Modification Example of Embodiment

Figure 36:
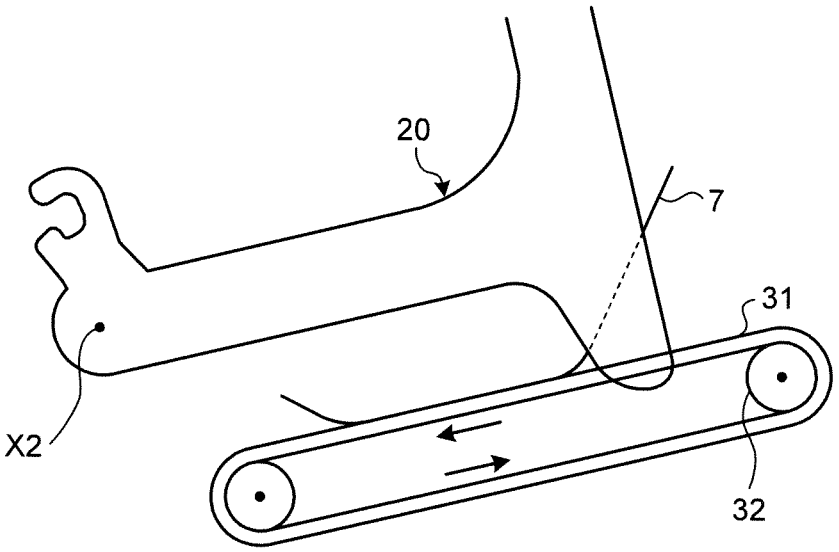
FIG. 36 is a diagram illustrating a schematic configuration of a feeding unit according to a seventh modification example of the embodiment.

FIG. 36 is a schematic configuration diagram of the feeding unit according to a seventh modification example of the embodiment. The feeding unit according to the seventh modification example is a transport belt 31 instead of the pick roller 6 of the above-described embodiment. The transport belt 31 is driven to rotate by a motor or the like via a roller 32 to rotate. The transport belt 31 sends the media S placed on the chute 1 in the conveying direction in the same manner as the pick roller 6. Furthermore, the feeding unit is not limited to the transport belt 31, and those exerting a transporting force on the medium S may also be employed as the feeding unit.

Eighth Modification Example of Embodiment

Figure 37:
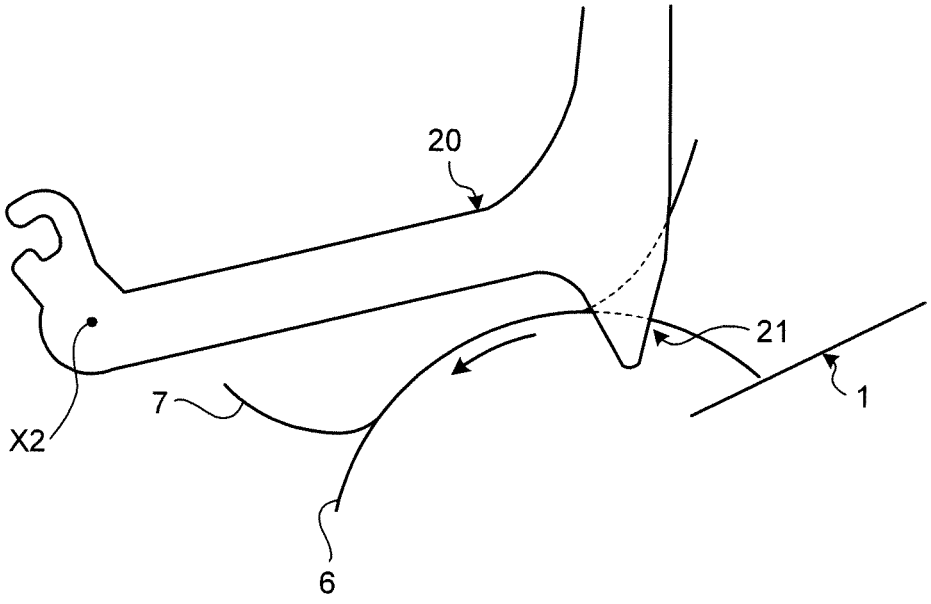
FIG. 37 is a diagram illustrating a schematic configuration of the second arm according to an eighth modification example of the embodiment.

FIG. 37 is a schematic configuration diagram of the second arm 20 according to an eighth modification example of the embodiment. As illustrated in FIG. 37, in the medium supply device 111 of the above-described embodiment, the first arm 10 may not be provided. In addition to the function of suppressing buckling of the medium S by the blocking portion 21 of the second arm 20, which blocks the space R1, a function of reinforcing the medium S may also be provided.

Ninth Modification Example of Embodiment

Figure 38:
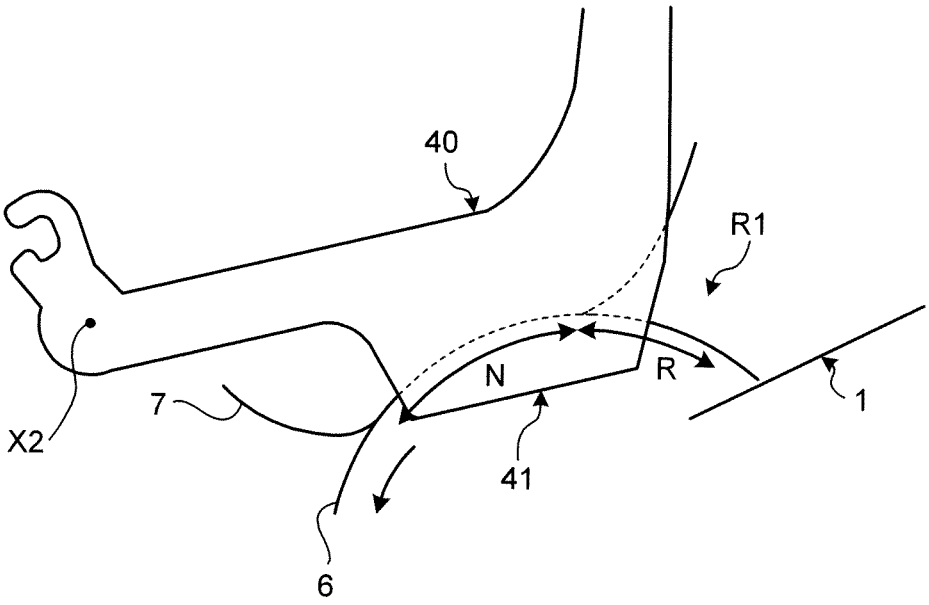
FIG. 38 is a diagram illustrating a schematic configuration of an arm according to a ninth modification example of the embodiment.

FIG. 38 is a schematic configuration diagram of an arm according to a ninth modification example of the embodiment. An arm 40 illustrated in FIG. 38 has both the function of the first arm 10 and the function of the second arm 20 of the above-described embodiment. The arm 40 includes a protrusion 41. The protrusion 41 is a portion having a trapezoidal shape which protrudes toward the pick roller 6 from the brake roller 7 side. The protrusion 41 extends to the nip region N from the upstream side region R in the conveying direction. The protrusion 41 has the function of blocking the space R1 on the upstream side in the conveying direction and the function of pressing and curving the medium S in the nip region N toward the pick roller 6. Accordingly, the protrusion 41 can exhibit both the effect of suppressing a jam of the medium S in the upstream side region R and the effect of suppressing a jam of the medium S in the nip region N.

In addition, in a case where the arm 40 as illustrated in FIG. 38 is provided, a mechanism which adjusts the amount of the arm 40 protruding toward the pick roller 6 from the brake roller 7 side and a biasing force Farm thereof may be provided. For example, by appropriately adjusting the protruding amount and the biasing force Farm depending on conditions such as the thickness of the medium S, the suppression of a jam, the suppression of feeding failure, the suppression of skewing, and the like can be balanced.

Tenth Modification Example of Embodiment

Figure 39:
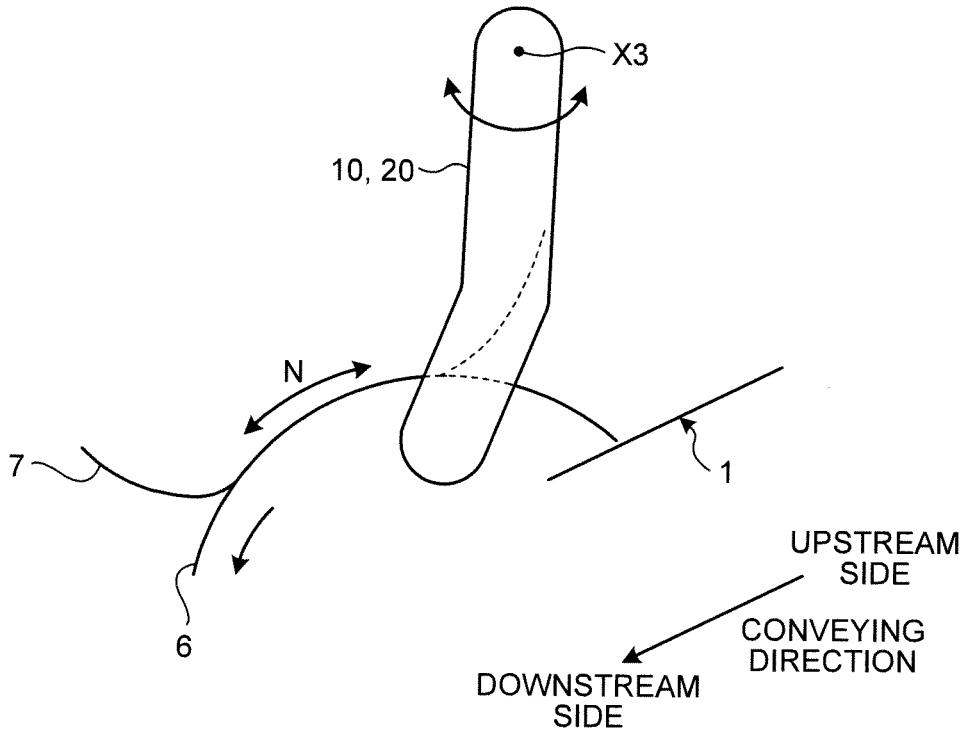
FIG. 39 is a diagram illustrating a schematic configuration of arms according to a tenth modification example of the embodiment.

FIG. 39 is a schematic configuration diagram of arms according to a tenth modification example of the embodiment. As illustrated in FIG. 39, the arms 10 and 20 may also be rotationally supported about a position X3 disposed on the upstream side in the conveying direction in relation to the nip region N as their rotational centers.

Eleventh Modification Example of Embodiment

Figure 40:
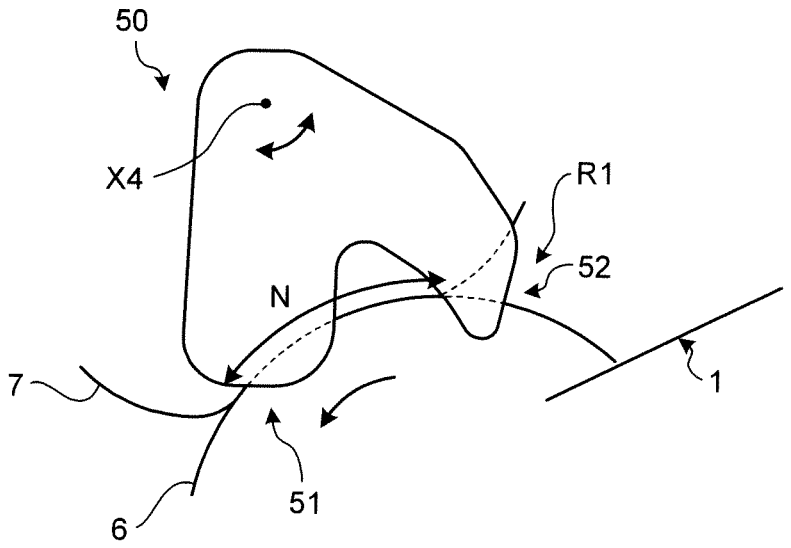
FIG. 40 is a diagram illustrating a schematic configuration of an arm according to an eleventh modification example of the embodiment.

FIG. 40 is a schematic configuration diagram of an arm according to an eleventh modification example of the embodiment. As illustrated in FIG. 40, both end portions of a bent arm 50 may act as a curve-forming portion 51 and a blocking portion 52. The arm 50 is bent in a substantially V shape and is rotationally supported about the bent portion (rotational center X4). One end portion of the arm 50 is the curve-forming portion 51 which reinforces the medium S in the nip region N, and the other end portion thereof is the blocking portion 52 which blocks the space R1 on the upstream side in the conveying direction in relation to the nip region N. The arm 50 is rotated about the rotational center X4 as its fulcrum. Therefore, for example, in a case where the medium S on the chute 1 is collapsed into a tapered shape and the blocking portion 52 is raised, the curve-forming portion 51 is pressed down against the pick roller 6 and can continuously exhibit the reinforcing function.

Twelfth Modification Example of Embodiment

Figure 41:
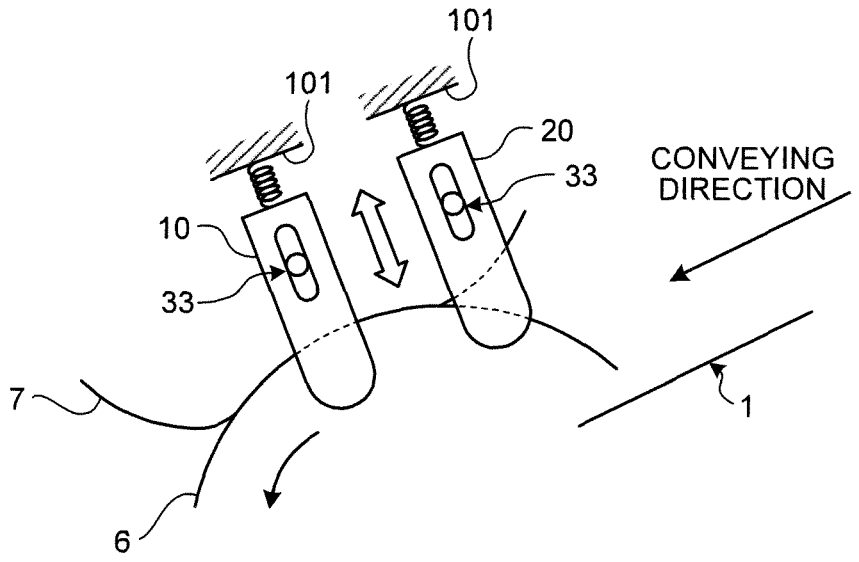
FIG. 41 is a diagram illustrating a schematic configuration of arms according to a twelfth modification example of the embodiment.

FIG. 41 is a schematic configuration diagram of arms according to a twelfth modification example of the embodiment. As illustrated in FIG. 41, the arms 10 and 20 may also be moved by sliding mechanism. The first arm 10 and the second arm 20 are supported by a casing 101 through spring-type sliding mechanism 33. The arms 10 and 20 can slide and move in a direction orthogonal to the conveying direction, that is, a direction orthogonal to the fed medium S. The arms 10 and 20 are biased in a direction toward the pick roller 6 from the brake roller 7 side by springs of the sliding mechanisms 33. When the arms 10 and 20 are pressed by the medium S, the arms 10 and 20 can be retracted toward the brake roller 7 side against the biasing forces of the springs. The arms 10 and 20 according to this modification example are not changed in position in the conveying direction even during sliding and thus can press the medium S at a target position.

Thirteenth Modification Example of Embodiment

Figure 42:
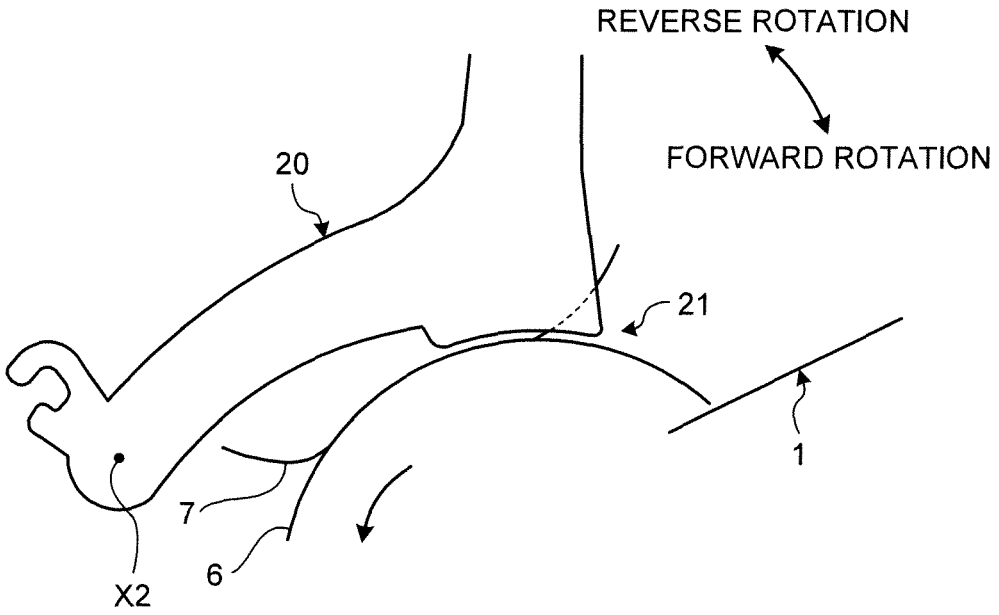
FIG. 42 is a diagram illustrating a schematic configuration of an arm according to a thirteenth modification example of the embodiment.
Figure 43:
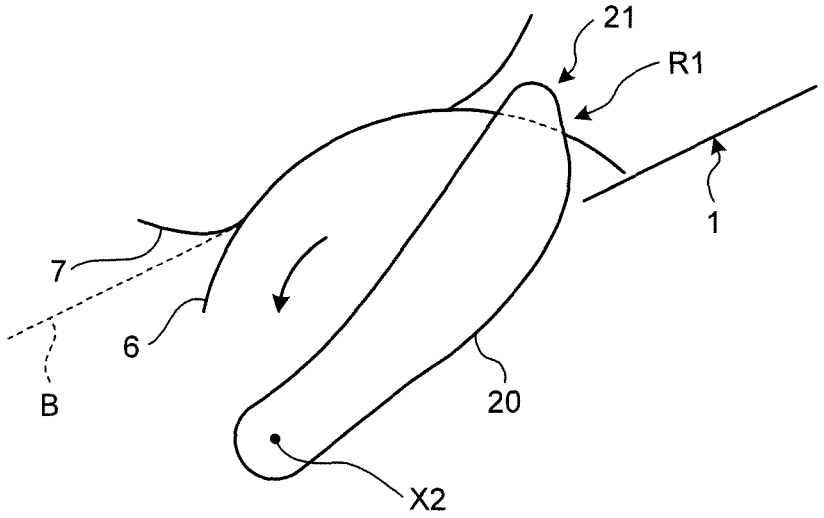
FIG. 43 is a diagram illustrating a schematic configuration of an arm according to a fourteenth modification example of the embodiment.

FIG. 42 is a schematic configuration diagram of an arm according to a thirteenth modification example of the embodiment. As illustrated in FIG. 42, the second arm 20 of the thirteenth modification example does not overlap the pick roller 6 when viewed in the axial direction of the pick roller 6. Even when the second arm 20 is at the position closest to the forward rotation side, the blocking portion 21 of the second arm 20 does not overlap the pick roller 6. Accordingly, the occurrence of feeding failure of the medium S is reduced. alleviate Fourteenth Modification Example of Embodiment FIG. 43 is a schematic configuration diagram of an arm according to a fourteenth modification example of the embodiment. As illustrated in FIG. 43, the center axis line X2 of the second arm 20 may be positioned on the pick roller 6 side in relation to the conveying path B of the medium S.

Fifteenth Modification Example of Embodiment

Figure 44:
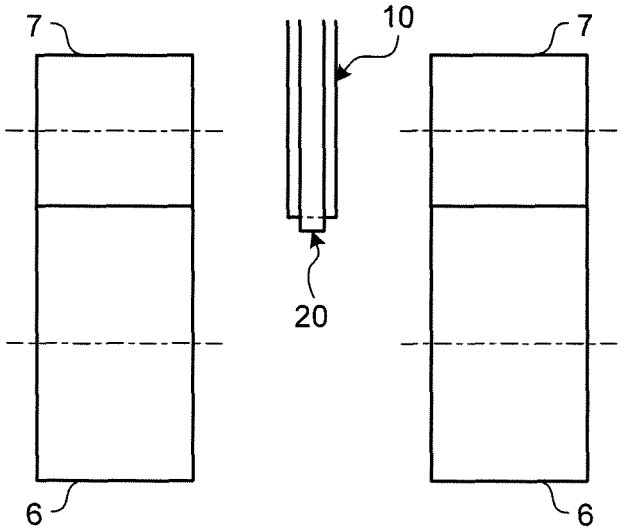
FIG. 44 is a diagram illustrating a schematic configuration of arms according to a fifteenth modification example of the embodiment.

FIG. 44 is a schematic configuration diagram of arms according to a fifteenth modification example of the embodiment. As illustrated in FIG. 44, the first arm 10 and the second arm 20 may overlap when viewed in a direction orthogonal to the axial direction of the pick roller 6. In this case, it is preferable that the rotation trajectory of the first arm 10 and the rotation trajectory of the second arm 20 do not interfere with each other.

Sixteenth Modification Example of Embodiment

Figure 45:
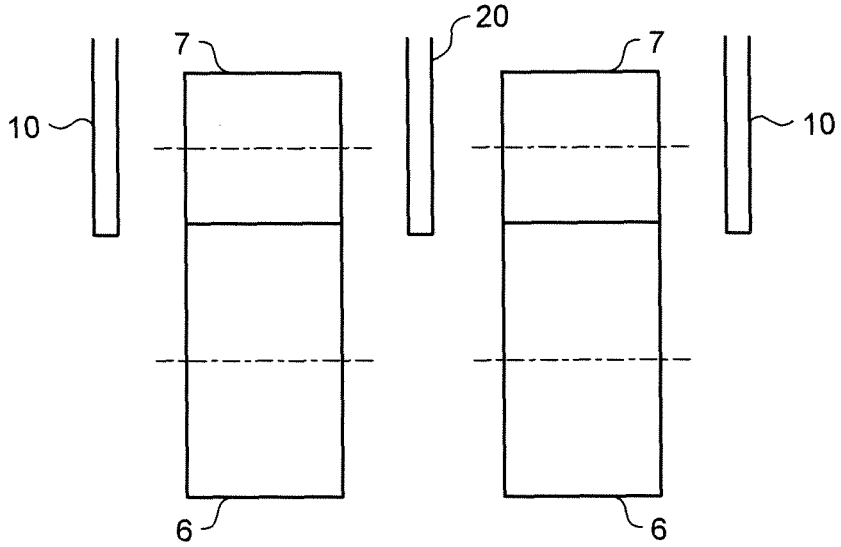
FIG. 45 is a diagram illustrating a schematic configuration of arms according to a sixteenth modification example of the embodiment.

FIG. 45 is a schematic configuration diagram of arms according to a sixteenth modification example of the embodiment. One of the first arm 10 or the second arm 20 may be disposed on the inner side in the axial direction, and the other may be disposed on the outer side in the axial direction. For example, as illustrated in FIG. 45, the second arm 20 may be disposed on the inner side interposed between the two brake rollers 7, and the two first arms 10 may be disposed on the outer side with the two brake rollers 7 interposed therebetween. In reverse, the first arm 10 may be disposed between the two brake rollers 7, and the two second arms 20 may be disposed on the outer side with the two brake rollers 7 interposed therebetween.

Seventeenth Modification Example of Embodiment

Figure 46:
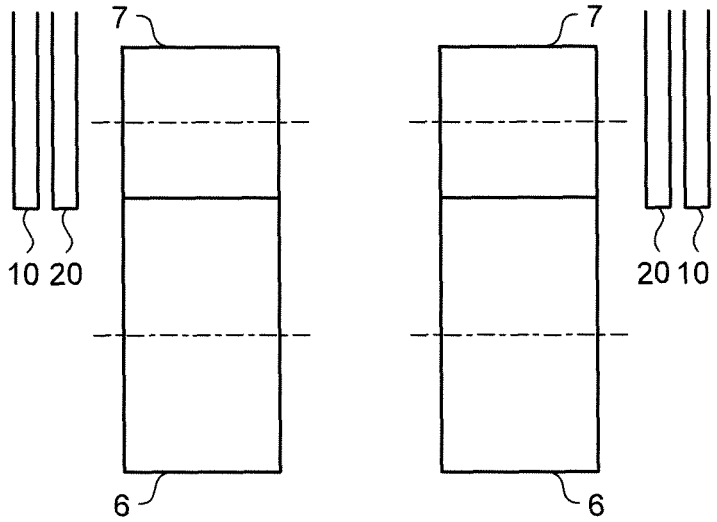
FIG. 46 is a diagram illustrating a schematic configuration of arms according to a seventeenth modification example of the embodiment.

FIG. 46 is a schematic configuration diagram of arms according to a seventeenth modification example of the embodiment. Both the first arm 10 and the second arm 20 may be disposed on the outer side in the axial direction in relation to the pick roller 6 and the brake roller 7. For example, as illustrated in FIG. 46, the two second arms 20 may be disposed with the two brake rollers 7 interposed therebetween, and the two first arms 10 may be disposed with the two second arms 20 interposed therebetween. The position of the first arms 10 and the position of the second arms 20 may be interchanged.

Eighteenth Modification Example of Embodiment

Figure 47:
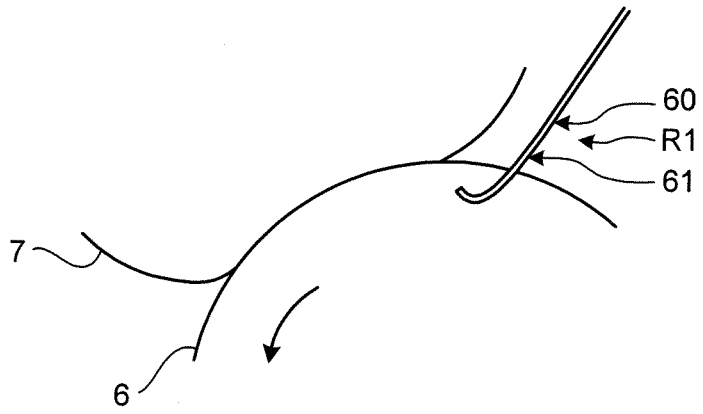
FIG. 47 is a diagram illustrating schematic configurations of a blocking portion and a curve-forming portion according to an eighteenth modification example of the embodiment.

FIG. 47 is a diagram illustrating the schematic configurations of a blocking portion and a curve-forming portion according to an eighteenth modification example of the embodiment. The blocking portion and the curve-forming portion may be leaf springs 60 instead of the arms 10 and 20 of the above-described embodiment. In FIG. 47, a portion of the leaf spring 60 is a blocking portion 61 which blocks the space R1 when viewed in the axial direction. The leaf spring 60 is an elastically deformable member. When the blocking portion 61 is pressed by the medium S, the leaf spring 60 deforms and the blocking portion 61 is retracted toward the brake roller 7 side. In the same manner, the curve-forming portion can be realized by the leaf spring 60.

Nineteenth Modification Example of Embodiment

Figure 48:
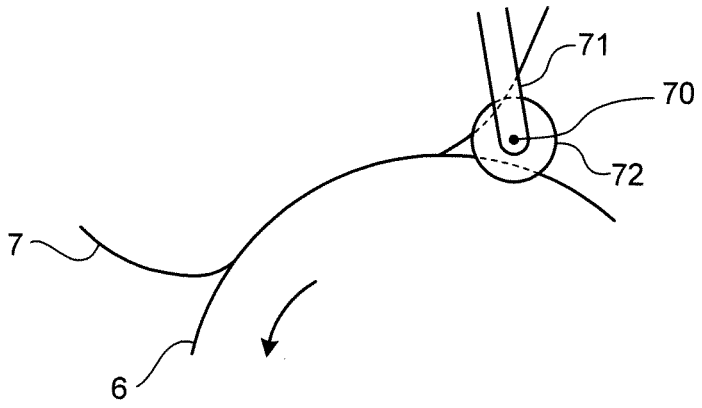
FIG. 48 is a diagram illustrating schematic configurations of a blocking portion and a curve-forming portion according to a nineteenth modification example of the embodiment.

FIG. 48 is a diagram illustrating the schematic configurations of a blocking portion and a curve-forming portion according to a nineteenth modification example of the embodiment. The blocking portion and the curve-forming portion may be rollers instead of the arms 10 and 20 of the above-described embodiment. In FIG. 48, a roller 72 functions as the blocking portion. The roller 72 is rotationally supported by a support shaft 71. The rotating shaft of the roller 72 is parallel to the rotating shaft of the pick roller 6. It is preferable that the support shaft 71 support the roller 72 so that the roller 72 is able to be retracted toward the brake roller 7. That is, it is preferable that a rotating shaft 70 of the roller 72 be movable in the longitudinal direction of the support shaft 71. Otherwise, it is preferable that the support shaft 71 itself be supported to be movable in a direction orthogonal to the conveying direction by a sliding mechanism or the like. In the same manner as the blocking portion, the curve-forming portion can be realized by the support shaft 71 and the roller 72.

Furthermore, the blocking portion and the curve-forming portion are not limited to the exemplified leaf spring 60 and the roller 72. For example, the blocking portion may have other configurations such as a flat plate-shaped guide capable of blocking the space R1, and the curve-forming portion may have other configurations such as a flat plate-shaped guide capable of curving and reinforcing the medium S.

Twentieth Modification Example of Embodiment

In the medium supply device 111 of the above-described embodiment, the component performances of the pressure applying spring Sp1 of the first arm 10 and the pressure applying spring Sp2 of the second arm 20 may be utilized in common. Due to the reduction in the number of types of components due to the common utilization, a reduction in cost and the like can be made. In addition, the biasing force Farm on each of the first arm 10 and the second arm 20 may be generated by a single pressure applying spring. In the above-described embodiment, coil springs are exemplified as the pressure applying springs Sp1 and Sp2 but are not limited thereto. The pressure applying springs Sp1 and Sp2 may employ those that can generate biasing forces Farm, such as a leaf spring or a resin having elasticity.

Further, the medium supply device 111 disclosed in the above-described embodiment and each of the modification examples is not limited to being mounted in the image reading apparatus 100. The medium supply device 111 may also be mounted in another apparatus such as an image forming apparatus.

The contents disclosed in the above-described embodiment and each of the modification examples can be appropriately combined to be implemented.

According to the medium supply device of the present invention, an advantage of suppressing the occurrence of a jam of a medium is obtained.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A medium supply device comprising:

a feeding unit that feeds a medium among one or more media placed on a placing table;

a separating unit that is arranged to come into pressure-contact with the feeding unit, a nip region being formed between the separating unit and the feeding unit;

a blocking portion included in a second arm that is movable, the blocking portion arranged between the feeding unit and the separating unit to block a space formed between the feeding unit and the separating unit in an upstream side of the nip region in a conveying direction of the medium; and a curve-forming portion included in a first arm, the curve-forming portion arranged on a downstream side in the conveying direction of the medium in relation to the blocking portion to press the medium interposed between the feeding unit and the separating unit toward the feeding unit to form a curve in a width direction of the medium, wherein the curve-forming portion and the blocking portion are separate members so that the curve-forming portion and the blocking portion are configured to move independently of each other, the first arm has a first rotating shaft and the second arm has a second rotating shaft, the first arm and the second arm being disposed on a side of the separating unit in relation to a conveying path of the medium, and a center axis line of the first rotating shaft and a center axis line of the second rotating shaft are different from each other.

2. The medium supply device according to claim 1, wherein the curve-forming portion overlaps the feeding unit when viewed in an axial direction of the feeding unit.

* * * * *